US009594334B2

(12) United States Patent
Nakayama

(10) Patent No.: US 9,594,334 B2
(45) Date of Patent: Mar. 14, 2017

(54) HEATER AND IMAGE HEATING APPARATUS INCLUDING THE SAME

(71) Applicant: CANON KABUSHIKI KAISHA, Tokyo (JP)

(72) Inventor: Toshinori Nakayama, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/718,672

(22) Filed: May 21, 2015

(65) Prior Publication Data

US 2015/0338805 A1 Nov. 26, 2015

(30) Foreign Application Priority Data

May 26, 2014 (JP) ..... 2014-108594

(51) Int. Cl.
*G03G 15/20* (2006.01)
*H05B 1/02* (2006.01)
(Continued)

(52) U.S. Cl.
CPC ..... *G03G 15/2053* (2013.01); *G03G 15/2042* (2013.01); *H05B 1/0241* (2013.01);
(Continued)

(58) Field of Classification Search
CPC ..... G03G 15/2042; G03G 15/2053; G03G 15/80; H05B 1/0241; H05B 3/20; H05B 3/24
See application file for complete search history.

(56) References Cited

U.S. PATENT DOCUMENTS 6,084,208 A 7/2000 Okuda et al.
6,336,009 B1 1/2002 Suzumi et al.
(Continued)

FOREIGN PATENT DOCUMENTS

JP 06-250539 9/1994
JP 07-160131 6/1995
(Continued)

OTHER PUBLICATIONS

EP Communication and Search Report mailed Mar. 1, 2016, issued in counterpart European Patent Application No. 15167933.9.
(Continued)

*Primary Examiner* — Erika J Villaluna
(74) *Attorney, Agent, or Firm* — Fitzpatrick, Cella, Harper & Scinto

(57) ABSTRACT

A heater usable with an image heating apparatus includes first and second terminals, a connector, and an endless heating belt. At least one first contact is provided on a substrate and connectable with the first terminal through the connector, and second contacts are provided on the substrate and connectable with the second terminal through the connector. The heater also includes electrodes, including a first electrode connected with the first contact and second electrodes connected with the second contacts, the first electrodes and the second electrodes being arranged alternately with predetermined gaps in a longitudinal direction of the substrate. A plurality of heat generating portions are provided between adjacent electrodes so as to connect between adjacent electrodes, and are capable of generating heat by the electric power supply between adjacent electrodes. The first contact and the second contacts are all disposed in one longitudinal end portion side of the substrate.

16 Claims, 14 Drawing Sheets

(51) Int. Cl.

| | |
|---|---|
| ***H05B 3/46*** | (2006.01) |
| ***H05B 3/06*** | (2006.01) |
| ***H05B 3/34*** | (2006.01) |

(52) U.S. Cl.
CPC ..... *H05B 3/06* (2013.01); *H05B 3/34* (2013.01); *H05B 3/46* (2013.01); *H05B 2203/006* (2013.01)

(56) References Cited

U.S. PATENT DOCUMENTS

| | | | |
|---|---|---|---|
| 6,882,804 | B2 | 4/2005 | Eskey |
| 7,260,351 | B2 | 8/2007 | Nakayama |
| 7,263,303 | B2 | 8/2007 | Nakayama |
| 7,343,130 | B2 | 3/2008 | Nakayama |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |
| 7,729,628 | B2 | 6/2010 | Nakayama |
| 7,907,861 | B2 | 3/2011 | Nakayama |
| 8,145,086 | B2 | 3/2012 | Chiyoda et al. |
| 8,306,446 | B2 | 11/2012 | Ito et al. |
| 8,559,837 | B2 | 10/2013 | Nakayama |
| 8,712,271 | B2 | 4/2014 | Nakayama et al. |
| 8,750,739 | B2 | 6/2014 | Tamaki et al. |
| 2004/0228667 | A1 | 11/2004 | Eskey |
| 2009/0230114 | A1 | 9/2009 | Taniguchi et al. |
| 2012/0224876 | A1 | 9/2012 | Nakayama et al. |
| 2012/0308280 | A1 | 12/2012 | Tsuruya et al. |
| 2013/0299480 | A1 | 11/2013 | Kakubari et al. |
| 2013/0322897 | A1 | 12/2013 | Yago et al. |

FOREIGN PATENT DOCUMENTS

| | | |
|---|---|---|
| JP | 2000-162909 | 6/2000 |
| JP | 2004-341523 | 12/2004 |
| JP | 2012-037613 | 2/2012 |
| RU | 2306588 C2 | 9/2007 |

OTHER PUBLICATIONS

Copending, unpublished U.S. Appl. No. 14/718,557 to Toshinori Nakayama, filed May 21, 2015.
Copending, unpublished U.S. Appl. No. 14/794,869 to Toshinori Nakayama, filed Jul. 9, 2015.
Copending, unpublished U.S. Appl. No. 14/719,497 to Toshinori Nakayama, filed May 22, 2015.
Copending, unpublished U.S. Appl. No. 14/799,056 to Masayuki Tamaki et al., filed Jul. 14, 2015.
Copending, unpublished U.S. Appl. No. 14/719,474 to Toshinori Nakayama, filed May 22, 2015.
U.S. Appl. No. 14/718,557, filed May 21, 2015, Toshinori Nakayama.
U.S. Appl. No. 14/794,869, filed Jul. 9, 2015, Toshinori Nakayama.
U.S. Appl. No. 14/719,497, filed May 22, 2015, Toshinori Nakayama.
U.S. Appl. No. 14/799,056, filed Jul. 14, 2015, Masayuki Tamaki.
U.S. Appl. No. 14/719,474, filed May 22, 2015, Toshinori Nakayama.
Russian Notice of Allowance dated Nov. 21, 2016, in related Russian Patent Application No. 2015118703.

PRIOR ART

HEATER AND IMAGE HEATING APPARATUS INCLUDING THE SAME

FIELD OF THE INVENTION AND RELATED ART

The present invention relates to a heater for heating an image on a sheet and an image heating apparatus provided with the same. The image heating apparatus is usable with an image forming apparatus such as a copying machine, a printer, a facsimile machine, a multifunction machine having a plurality of functions thereof or the like.

An image forming apparatus is known in which a toner image is formed on the sheet and is fixed on the sheet by heat and pressure in a fixing device (image heating apparatus). As for such a fixing device, a type of fixing device is proposed (Japanese Laid-open Patent Application 2012-37613) in which a heat generating element (heater) is contacted to an inner surface of a thin flexible belt to apply heat to the belt. Such a fixing device is advantageous in that the structure has a low thermal capacity, and therefore, the temperature rise to the fixing operation allowable is quick.

Japanese Laid-open Patent Application 2012-37613 discloses a structure of a fixing device in which a heat generating region width of a heater is controlled in accordance with a width size of the sheet. As shown in FIG. 11, the fixing device comprises electrodes 1027 (1027*a*-1027*f*) arranged in a longitudinal direction of a substrate 1021 and heat generating resistance layers 1025 (1025*a*-1025*e*), and the electric power supply is supplied through the electrodes to the heat generating resistance layers 1025 (1025*a*-1025*e*) so that the heat generating resistance layer generates heat.

In this fixing device, each electrode is electrically connected with an electroconductive line layers 1029 (1029*a*, 1029*b*) formed on the substrate. More in detail, the electroconductive line layer 1029*b* connected with the electrode 1027*b* and the electrode 1027*d* extends toward one longitudinal end of the substrate. The electroconductive line layer 1029*a* connected with the electrode 1027*c* and the electrode 1027*e* extends toward another longitudinal end of the substrate. In the one end portion of the substrate with respect to the longitudinal direction, the electrode 1027*a* and the electroconductive line layer 1029*b* are connectable with respective electroconductive members. In the other end portion of the substrate with respect to the longitudinal direction, the electrode 1027*f* and the electroconductive line layer 1029*a* are connectable with respective electroconductive members. More in detail, the opposite longitudinal end portions of the substrate are not coated with an insulation layer for protecting the electroconductive lines, and the electroconductive line layers 1029*a*, 1029*b* and the electrodes 1027*a*, 1027*f* are exposed. Here, for simplicity, the exposed portion of the electroconductive line layer 1029*a* will be called electrical contact A, the exposed portion of the electroconductive line layer 1029*b* is called electrical contact B, the exposed portion of the electrode 1027*a* will be called electrical contact C, and the exposed portion of the electrode 1027*f* will be called electrical contact D. By electrically connecting the electrical contact A, the electrical contact B, the electrical contact C and the electrical contact D to the electroconductive member, the heater 1006 is connected with a voltage supply circuit. The voltage supply circuit includes an AC voltage source and switches 1033 (1033*a*, 1033*b*, 1033*c*, 1033*d*), by combinations of the actuations of which heater energization pattern is controlled. In other words, the electroconductive line layers 1029*a*, 1029*b* are selectively connected with a voltage source contact 1031*a* or a voltage source contact 1031*b* in accordance with the intended connection pattern. With such a structure, the fixing device disclosed in Japanese Laid-open Patent Application 2012-37613 changes the width size of the heat generating region of the heat generating resistance layer 1025 in accordance with the width size of the sheet to be heated thereby.

Japanese Laid-open Patent Application No. 2012-37613 does not disclose detail of the electroconductive member, but an example of the electroconductive member is a contact type connector electrically connectable with the electrical contact of the heater. The connector is provided with contact terminals corresponding to the respective electrical contacts, by the contact terminals contacting with the electrical contacts, the electric power can be supplied to the heater. Because the heater is provided inside the belt, the longitudinal end portions of the heater have to be protruded beyond the end portions of the belt so as to avoid interference between the belt and the connectors of the heater.

Therefore, using the contact type connector in the heater disclosed in Japanese Laid-open Patent Application 2012-37613, one longitudinal end of the substrate protrudes beyond the end portion of the belt to permit mounting of the connectors to the electrical contacts B and C, and the other longitudinal end of the substrate protrudes beyond the end portion of the belt to permit mounting of the connectors to the electrical contacts A and D. Such protrusions require long size of the substrate 1021 with the result of increase in cost of the heater. A heater with which a width size of the heat generating region is changeable is desired to have a short length of the substrate, while a connector is mountable thereto.

SUMMARY OF THE INVENTION

Accordingly, it is an object of the present invention to provide a heater having a relatively smaller length.

It is another object of the present invention to provide an image heating apparatus having a relatively smaller length.

According to an aspect of the present invention, there is provided a heater usable with an image heating apparatus including an electric energy supplying portion provided with a first terminal and a second terminal, a connector portion electrically connected with the electric energy supplying portion, and an endless belt for heating an image on a sheet, wherein said heater is contactable to the belt to heat the belt, said heater comprising a substrate; at least one first electrical contact provided on said substrate and electrically connectable with the first terminal through the connector portion; a plurality of second electrical contacts provided on said substrate and electrically connectable with the second terminal through the connector portion; a plurality of electrode portions including a first electrode portion electrically connected with said first electrical contact and second electrode portions electrically connected with said second electrical contacts, said first electrode portions and said second electrode portions being arranged alternately with predetermined gaps in a longitudinal direction of said substrate; and a plurality of heat generating portions provided between adjacent ones of said electrode portions so as to electrically connect between adjacent electrode portions, said heat generating portions being capable of generating heat by the electric power supply between adjacent electrode portions; wherein said first electrical contact and said second electrical contacts are all disposed in one end portion side of said substrate with respect to the longitudinal direction.

Further features of the present invention will become apparent from the following description of exemplary embodiments with reference to the attached drawings.

Figure 12:
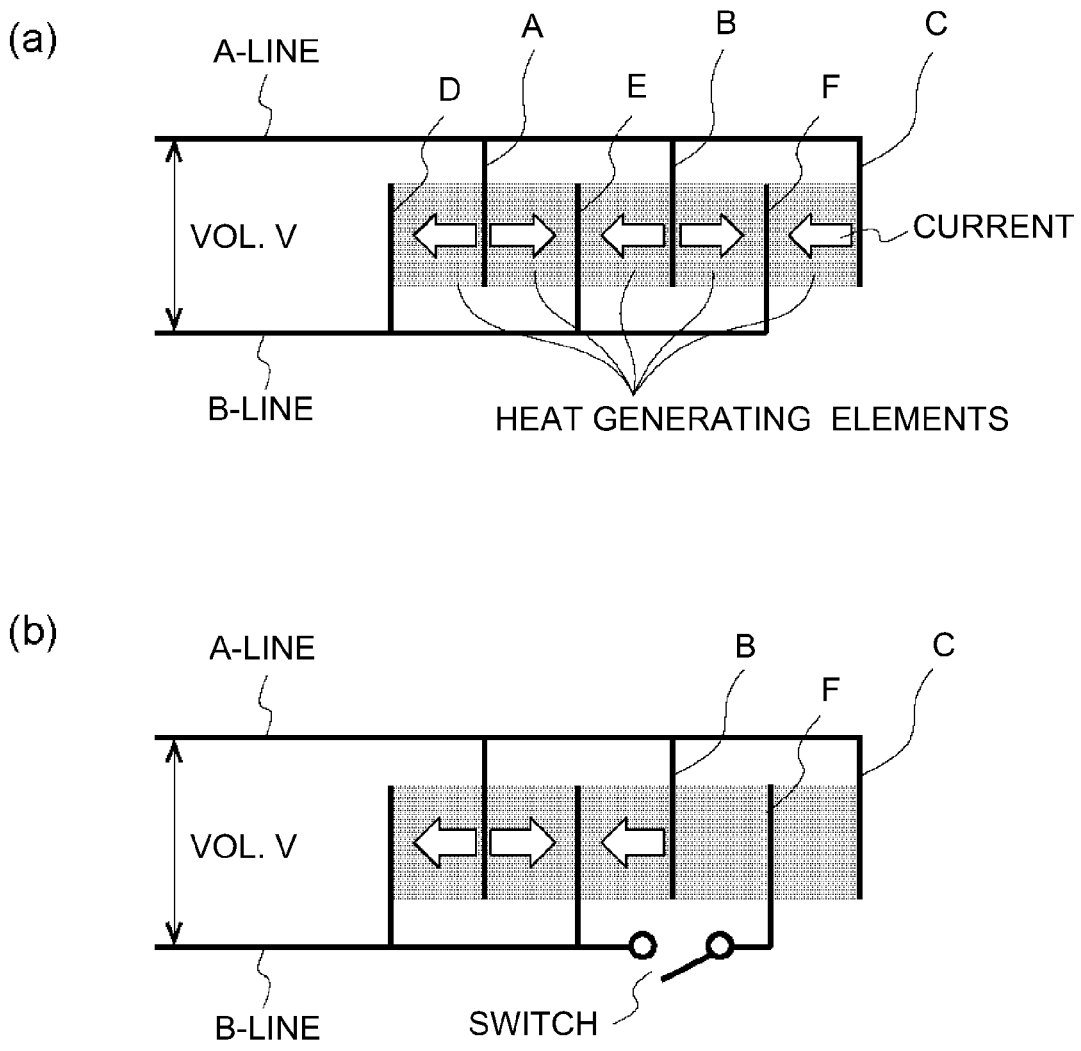

Part (a) of FIG. 12 illustrates a heat generating type for a heater, and part (b) illustrates a switching system for the heat generating region of the heater.

Figure 13:
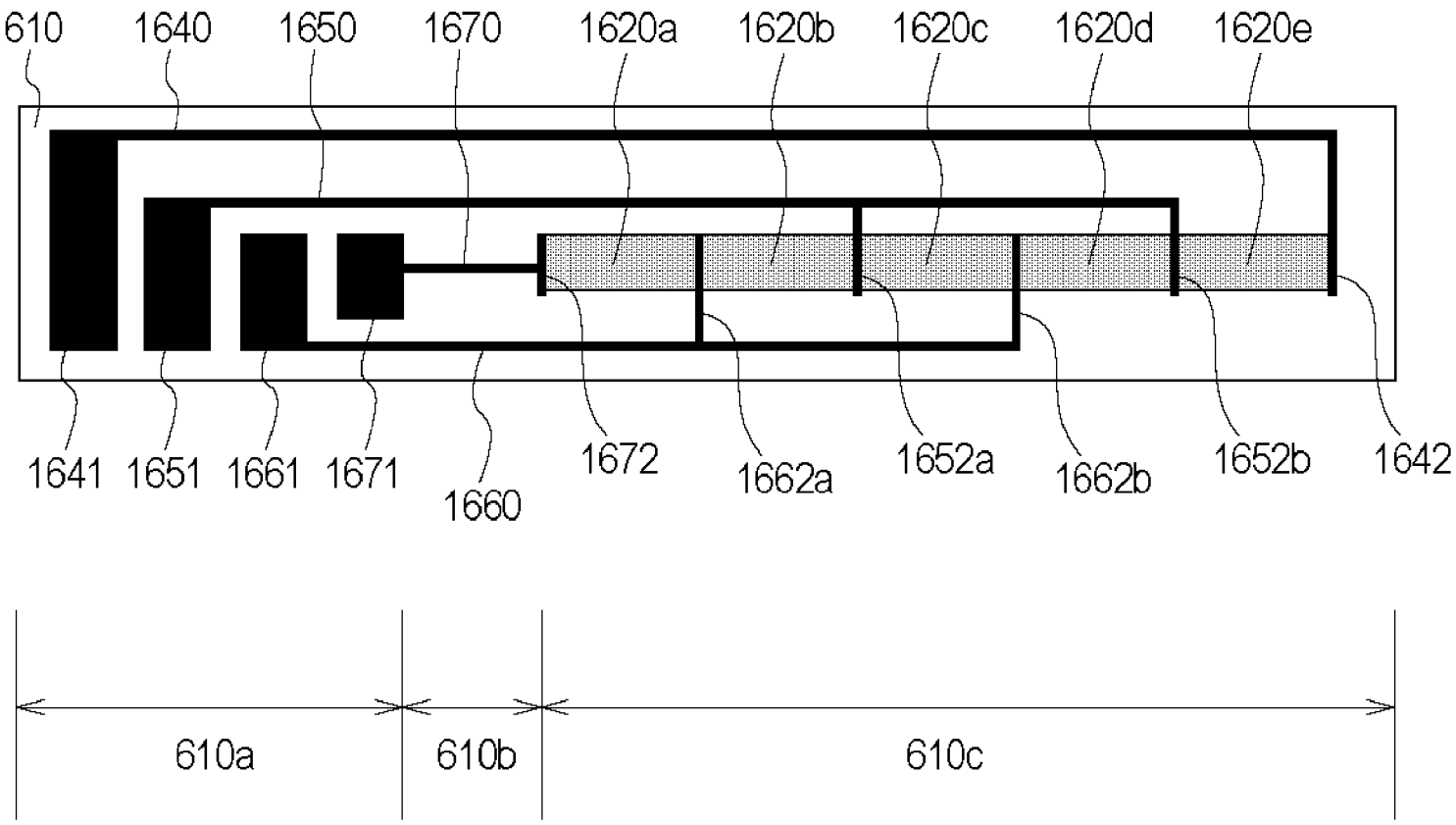

FIG. 13 illustrates a structure of a heater Embodiment 2.

Figure 14:
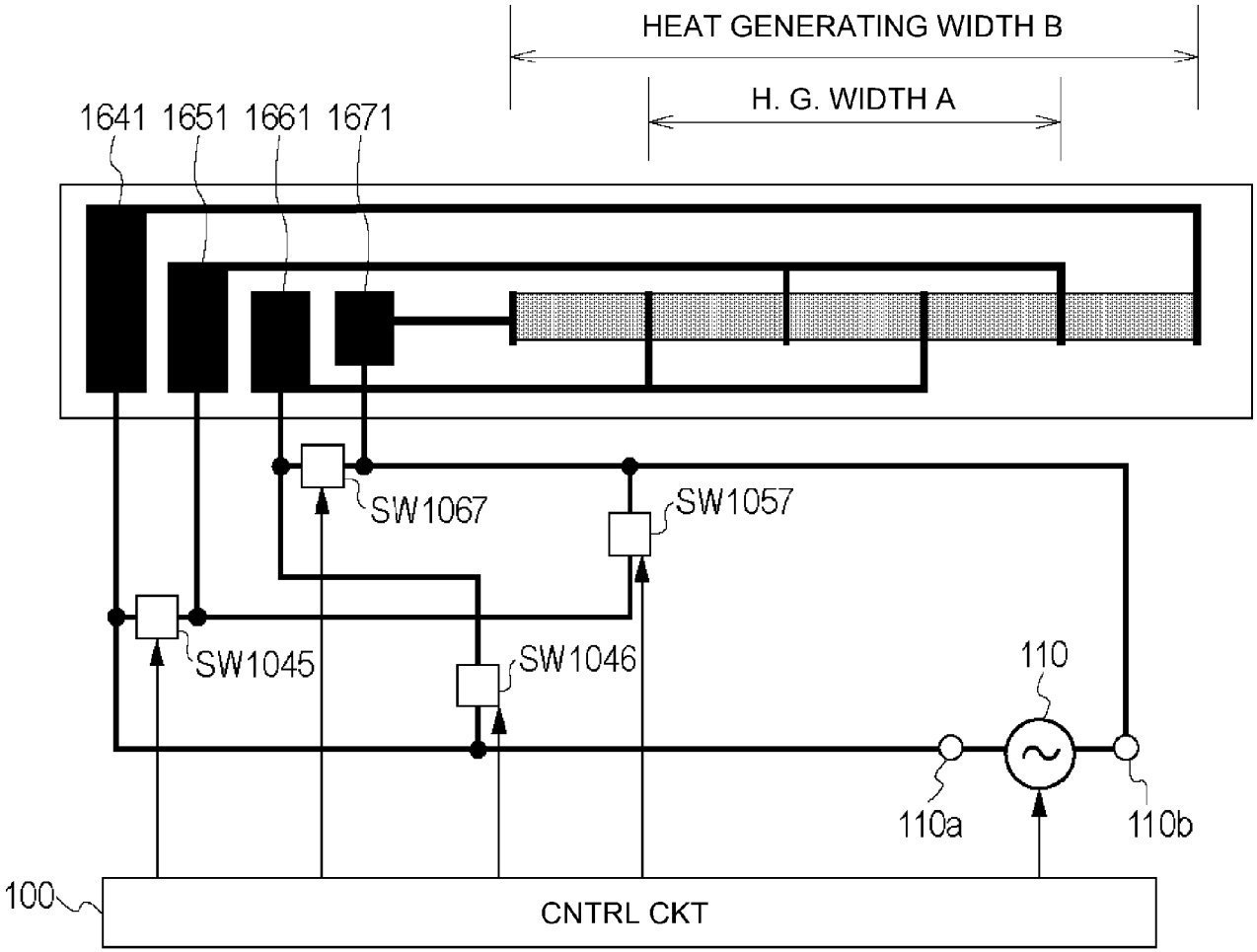

FIG. 14 illustrates the structural relationship of the image heating apparatus according to an Embodiment 2.

DESCRIPTION OF THE EMBODIMENTS

Embodiments of the present invention will be described in conjunction with the accompanying drawings. In this embodiment, the image forming apparatus is a laser beam printer using an electrophotographic process as an example. The laser beam printer will be simply called printer.

Embodiment 1

Image Forming Apparatus

Figure 1:
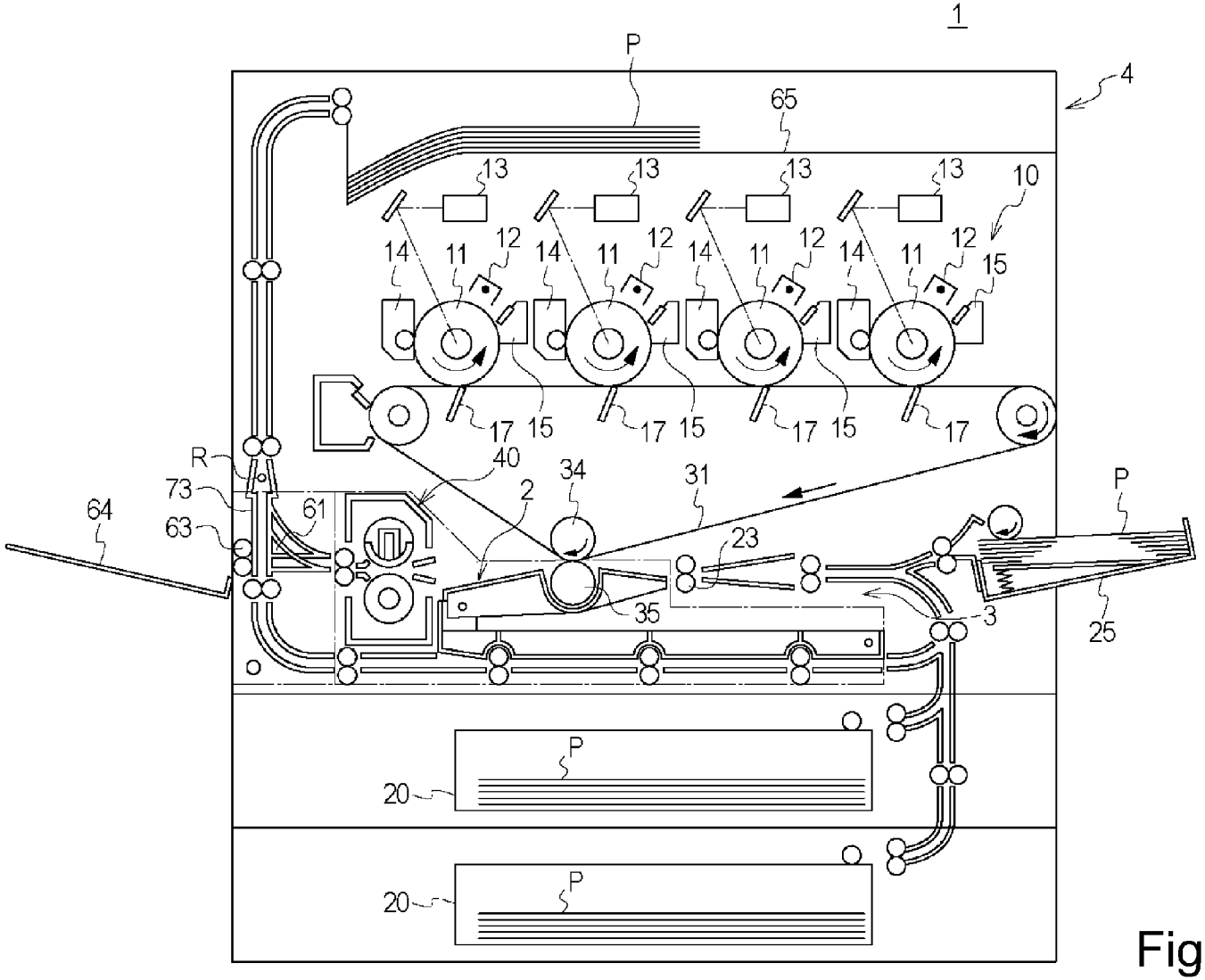
FIG. 1 is a section of view of the image forming apparatus according to an Embodiment 1 of the present invention.

FIG. 1 is a sectional view of the printer 1 which is the image forming apparatus of this embodiment. The printer 1 comprises an image forming station 10 and a fixing device 40, in which a toner image formed on the photosensitive drum 11 is transferred onto a sheet P, and is fixed on the sheet P, by which an image is formed on the sheet P. Referring to FIG. 1, the structures of the apparatus will be described in detail.

As shown in FIG. 1, the printer 1 includes image forming stations 10 for forming respective color toner images Y (yellow), M (magenta), C (cyan) and), Bk (black)). The image forming stations 10 include respective photosensitive drums 11 (11Y, 11M, 11C, 11Bk) corresponding to Y, M, C, Bk colors, and are arranged in the order named from the left side. Around each drum 11, similar elements are provided as follows: a charger 12 (12Y, 12M, 12C, 12Bk); an exposure device 13 (13Y, 13M, 13C, 13Bk); a developing device 14 (14Y, 14M, 14C, 14Bk); a primary transfer blade 17 (17Y, 17M, 17C, 17Bk); and a cleaner 15 (15Y, 15M, 15C, 15Bk). The structure for the Bk toner image formation will be described as a representative, and the descriptions for the other colors are omitted for simplicity by assigning the like reference numerals. So, the elements will be simply called photosensitive drum 11, charger 12, exposure device 13, developing device 14, primary transfer blade 17 and cleaner 15 with these reference numerals.

The photosensitive drum 11 as an electrophotographic photosensitive member is rotated by a driving source (unshown) in the direction indicated by an arrow (counterclockwise direction in FIG. 1). Around the photosensitive drum 11, the charger 12, the exposure device 13, the developing device 14, the primary transfer blade 17 and the cleaner 15 are provided in the order named.

A surface of the photosensitive drum 11 is electrically charged by the charger 12. Thereafter, the surface of the photosensitive drum 11 is exposed to a laser beam in accordance with image information by the exposure device 13, so that an electrostatic latent image is formed. The electrostatic latent image is developed into a Bk toner image by the developing device 14. At this time, similar processes are carried out for the other colors. The toner image is transferred from the photosensitive drum 11 onto an intermediary transfer belt 31 by the primary transfer blade 17 sequentially (primary-transfer). The toner remaining on the photosensitive drum 11 after the primary-image transfer is removed by the cleaner 15. By this, the surface of the photosensitive drum 11 is cleaned so as to be prepared for the next image formation.

On the other hand, the sheet P contained in a feeding cassette 20 is placed on a multi-feeding tray 25, picked up by a feeding mechanism (unshown), and fed to a pair of registration rollers. The sheet P is a member on which the image is formed. Specific examples of the sheet P include plain paper, thick sheet, resin material sheet, overhead projector film or the like. The pair of registration rollers 23 stop the sheet P the correct oblique feeding. The registration rollers 23 then feed the sheet P into an area between the intermediary transfer belt 31 and the secondary transfer roller 35 in timed relation with the toner image on the intermediary transfer belt 31. The roller 35 functions to transfer the color toner images from the intermediary transfer belt 31 onto the sheet P. Thereafter, the sheet P is fed into the fixing device (image heating apparatus) 40. The fixing device 40 applies heat and pressure to the toner image T on the sheet P to fix the toner image on the sheet P.

[Fixing Device]

Figure 2:
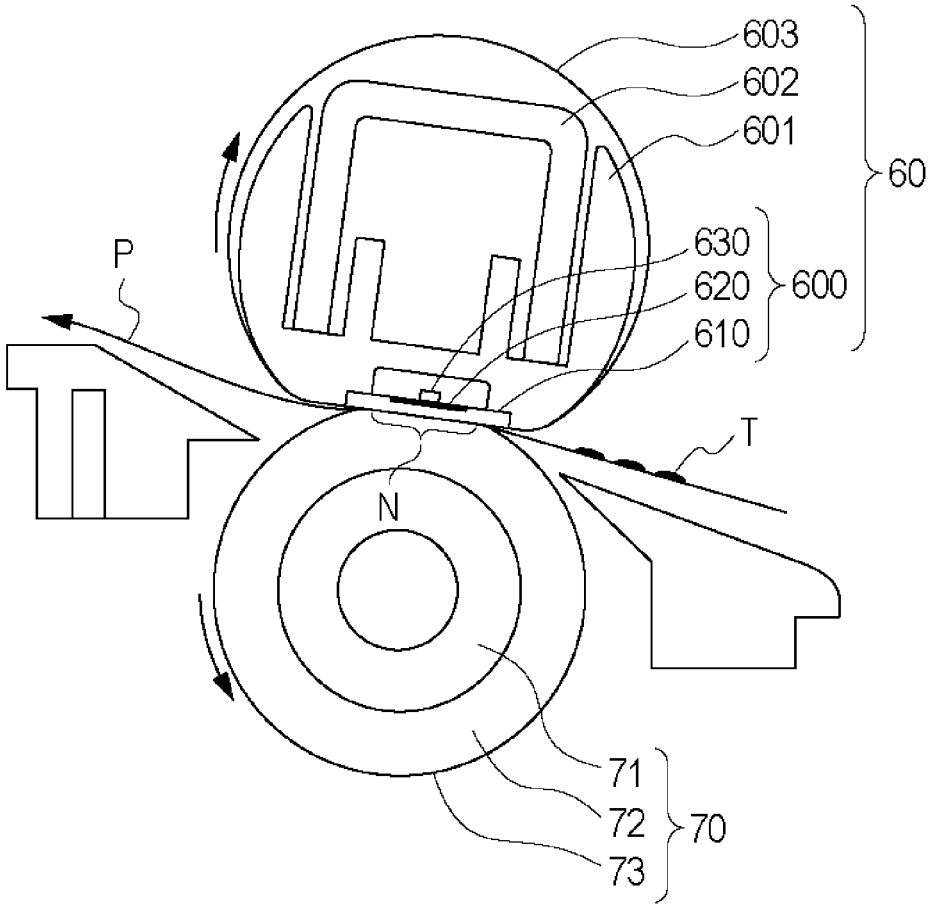
FIG. 2 is a sectional view of an image heating apparatus according to an Embodiment 1 of the present invention.
Figure 3:
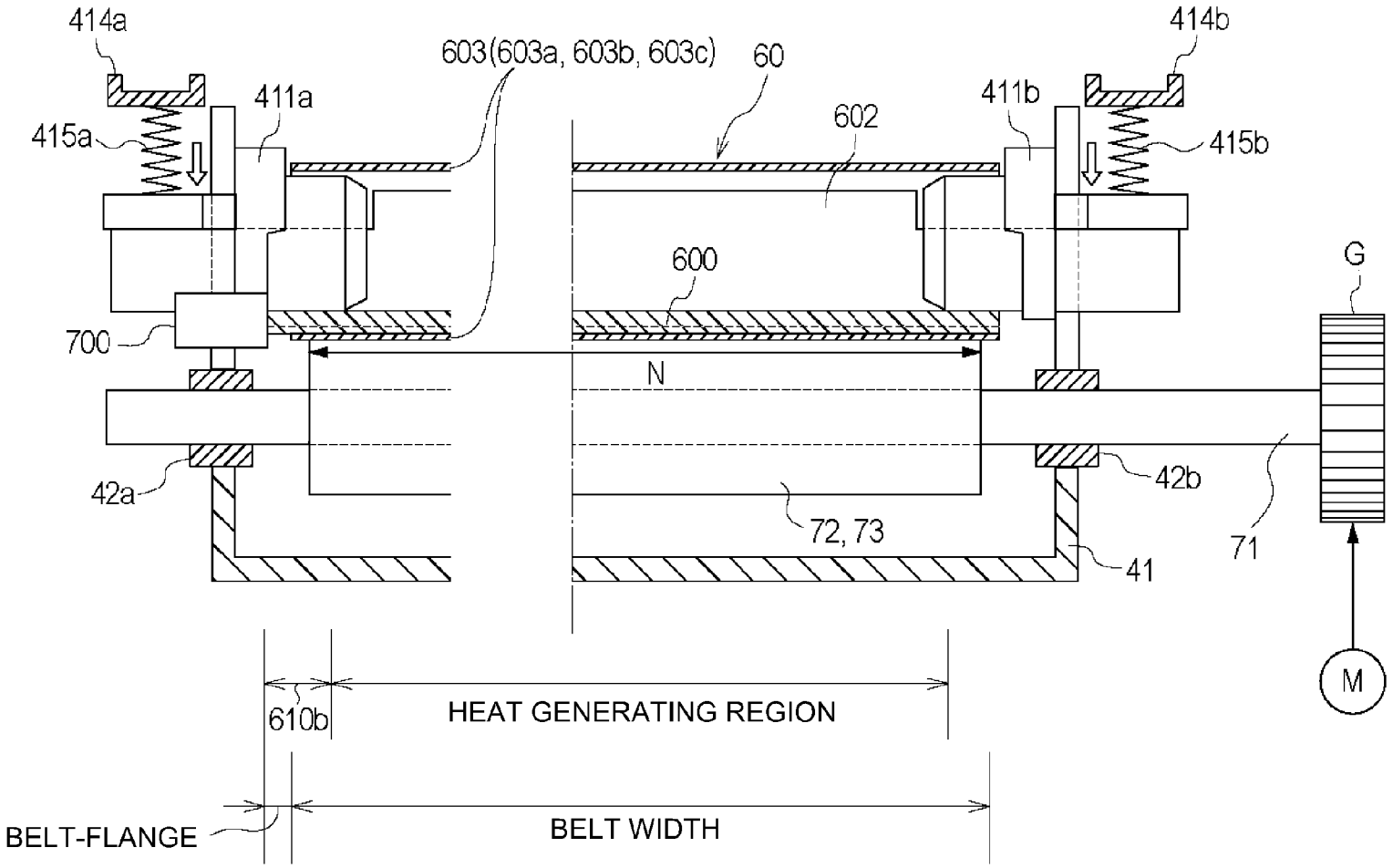
FIG. 3 is a front view of an image heating apparatus according to Embodiment 1 of the present invention.
Figure 5:
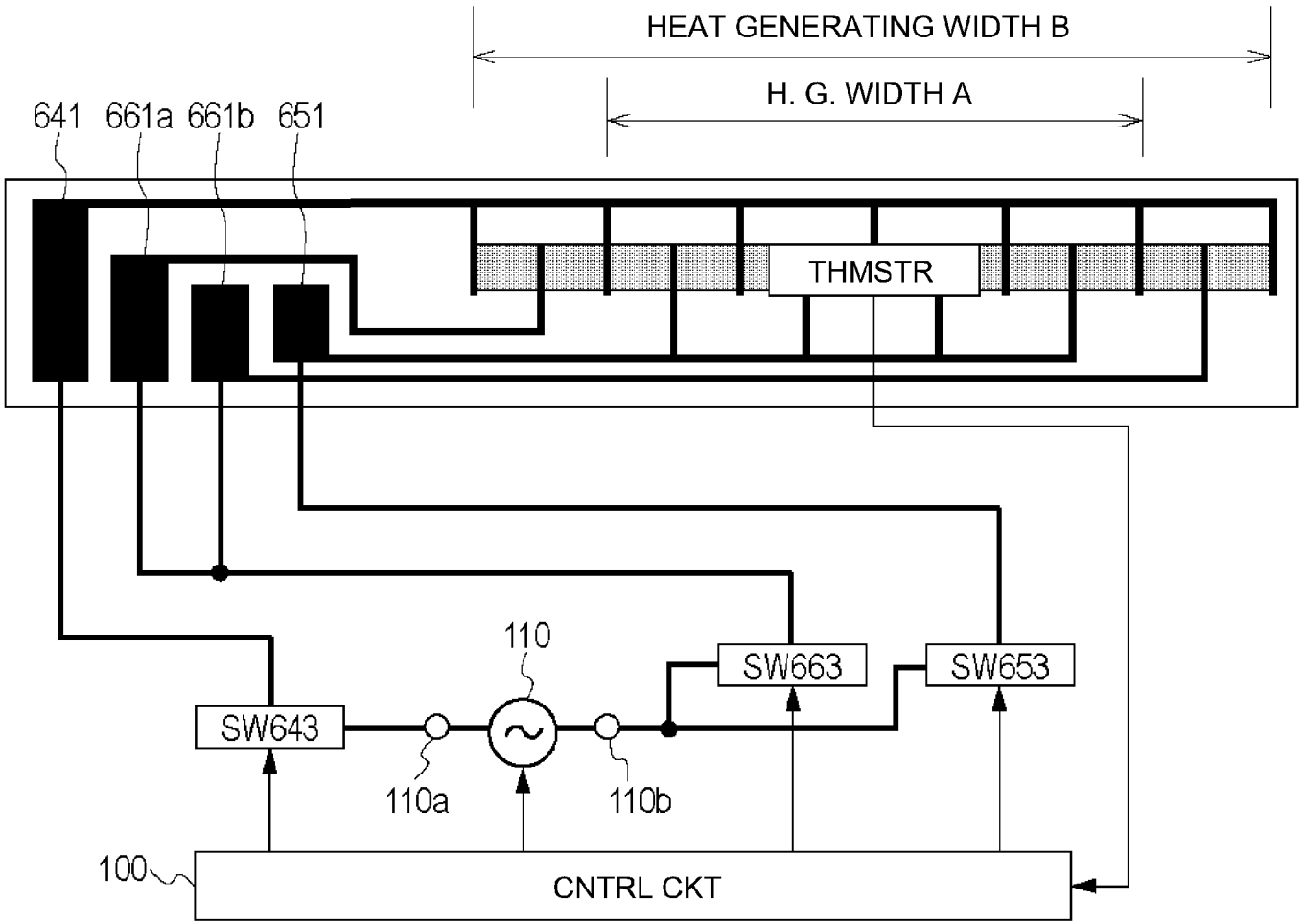
FIG. 5 illustrates the structural relationship of the image heating apparatus according to an Embodiment 1.

The fixing device 40 which is the image heating apparatus used in the printer 1 will be described. FIG. 2 is a sectional view of the fixing device 40. FIG. 3 is a front view of the fixing device 40. FIG. 5 illustrates a structural relationship of the fixing device 40.

The fixing device 40 is an image heating apparatus for heating the image on the sheet by a heater unit 60 (unit 60). The unit 60 includes a flexible thin fixing belt 603 and a heater 600 contacted to the inner surface of the belt 603 to heat the belt 603 (low thermal capacity structure). Therefore, the belt 603 can be efficiently heated, so that quick temperature rise at the start of the fixing operation is accomplished. As shown in FIG. 2, the belt 603 is nipped between the heater 600 and the pressing roller 70 (roller 70), by which a nip N is formed. The belt 603 rotates in the direction indicated by the arrow (clockwise in FIG. 2), and the roller 70 is rotated in the direction indicated by the arrow (counterclockwise in FIG. 2) 29 to nip and feed the sheet P supplied to the nip N. At this time, the heat from the heater 600 is supplied to the sheet P through the belt 603, and therefore, the toner image T on the sheet P is heated and pressed by the nip N, so that the toner image is fixed on the sheet P by the heat and pressure. The sheet P having passed through the fixing nip N is separated from the belt 603 and is discharged. In this embodiment, the fixing process is carried out as described above. The structure of the fixing device 40 will be described in detail.

Unit 60 is a unit for heating and pressing an image on the sheet P. A longitudinal direction of the unit 60 is parallel with the longitudinal direction of the roller 70. The unit 60 comprises a heater 600, a heater holder 601, a support stay 602 and a belt 603.

The heater 600 is a heating member for heating the belt 603, slidably contacting with the inner surface of the belt 603. The heater 600 is pressed to the inside surface of the belt 603 toward the roller 70 so as to provide a desired nip width of the nip N. The dimensions of the heater 600 in this embodiment are 5-20 mm in the width (the dimension as measured in the left-right direction in FIG. 2), 350-400 mm in the length (the dimension measured in the front-rear direction in FIG. 2), and 0.5-2 mm in the thickness. The heater 600 comprises a substrate 610 elongated in a direction perpendicular to the feeding direction of the sheet P (widthwise direction of the sheet P), and a heat generating resistor 620 (heat generating element 620).

The heater 600 is fixed on the lower surface of the heater holder 601 along the longitudinal direction of the heater holder 601. In this embodiment, the heat generating element 620 is provided on the back side of the substrate 610 which is not in slidable contact with the belt 603, but the heat generating element 620 may be provided on the front surface of the substrate 610 which is in slidable contact with the belt 603. However, the heat generating element 620 is preferably provided on the back side of the substrate 610, by which uniform heating effect to the substrate 610 is accomplished, from the standpoint of preventing non-uniform heat application which may be caused by a non-heat generating portion of the heat generating element 620. The details of the heater 600 will be described hereinafter.

The belt 603 is a cylindrical (endless) belt (film) for heating the image on the sheet in the nip N. The belt 603 comprises a base material 603*a*, an elastic layer 603*b* thereon, and a parting layer 603*c* on the elastic layer 603*b*, for example. The base material 603*a* may be made of metal material such as stainless steel or nickel, or a heat resistive resin material such as polyimide. The elastic layer 603*b* may be made of an elastic and heat resistive material such as a silicone rubber or a fluorine-containing rubber. The parting layer 603*c* may be made of fluorinated resin material or silicone resin material.

The belt 603 of this embodiment has dimensions of approx. 30 mm in the outer diameter, approx. 330 mm in the length (the dimension measured in the front-rear direction in FIG. 2), approx. 30 μm in the thickness, and the material of the base material 603*a* is nickel. The silicone rubber elastic layer 603*b* having a thickness of approx. 400 μm is formed on the base material 603*a*, and a fluorine resin tube (parting layer 603*c*) having a thickness of approx. 20 μm coats the elastic layer 603*b*.

The belt contacting surface of the substrate 610 may be provided with a polyimide layer having a thickness of approx. 10 μm as a sliding layer 603*d*. When the polyimide layer is provided, the rubbing resistance between the fixing belt 603 and the heater 600 is low, and therefore, the wearing of the inner surface of the belt 603 can be suppressed. In order to further enhance the slidability, a lubricant such as grease may be applied to the inner surface of the belt.

The heater holder 601 (holder 601) functions to hold the heater 600 in the state of urging the heater 600 toward the inner surface of the belt 603. The holder 601 has a semi-arcuate cross-section (the surface of FIG. 2) and functions to regulate a rotation orbit of the belt 603. The holder 601 may be made of heat resistive resin material or the like. In this embodiment, it is Zenite 7755 (tradename) available from Dupont.

The support stay 602 supports the heater 600 by way of the holder 601. The support stay 602 is preferably made of a material which is not easily deformed even when a high pressure is applied thereto, and in this embodiment, it is made of SUS304 (stainless steel).

As shown in FIG. 3, the support stay 602 is supported by left and right flanges 411*a* and 411*b* at the opposite end portions with respect to the longitudinal direction. The flanges 411*a* and 411*b* may be simply called flange 411. The flange 411 regulates the movement of the belt 603 in the longitudinal direction and the circumferential direction configuration of the belt 603. The flange 411 is made of heat resistive resin material or the like. In this embodiment, it is PPS (polyphenylenesulfide resin material).

Between the flange 411*a* and a pressing arm 414*a*, an urging spring 415*a* is compressed. Also, between a flange 411*b* and a pressing arm 414*b*, an urging spring 415*b* is compressed. The urging springs 415*a* and 415*b* may be simply called urging spring 415. With such a structure, an elastic force of the urging spring 415 is applied to the heater 600 through the flange 411 and the support stay 602. The belt 603 is pressed against the upper surface of the roller 70 at a predetermined urging force to form the nip N having a predetermined nip width. In this embodiment, the pressure is approx. 156.8 N at one end portion side and approx. 313.6 N (32 kgf) in total.

As shown in FIG. 3, a connector 700 is provided as an electric energy supply member electrically connected with the heater 600 to supply the electric power to the heater 600. The connector 700 is detachably provided at one longitudinal end portion of the heater 600. The connector 700 is easily detachably mounted to the heater 600, and therefore, assembling of the fixing device 40 and the exchange of the heater 600 or belt 603 upon damage of the heater 600 is easy, thus providing good maintenance property. Details of the connector 700 will be described hereinafter. The connector is a nipping member which nips the heater 600 in the front and back direction at the position widthwisely outside the belt.

As shown in FIG. 2, the roller 70 is a nip forming member which contacts an outer surface of the belt 603 to cooperate with the belt 603 to form the nip N. The roller 70 has a multi-layer structure, including a core made of metal material, the multi-layer structure including an elastic layer 72 on the metal core 71, and a parting layer 73 on the elastic layer 72. Examples of the materials of the metal core 71 include SUS (stainless steel), SUM (sulfur and sulfur-containing free-machining steel), Al (aluminum) or the like. Examples of the materials of the elastic layer 72 include an elastic solid rubber layer, an elastic foam rubber layer, an elastic porous rubber layer or the like. Examples of the materials of the parting layer 73 include fluorinated resin material.

The roller 70 of this embodiment includes a metal core 71 of steel, an elastic layer 72 of silicone rubber foam on the metal core 71, and a parting layer 73 of fluorine resin tube on the elastic layer 72. Dimensions of the portion of the roller 70 having the elastic layer 72 and the parting layer 73 are approx. 25 mm in outer diameter, and approx. 330 mm in length.

A thermister 630 is a temperature sensor provided on a back side of the heater 600 (opposite side from the sliding surface side). The thermister 630 is bonded to the heater 600 in the state that it is insulated from the heat generating element 620. The thermister 630 has a function of detecting a temperature of the heater 600. As shown in FIG. 5, the thermister 630 is connected with a control circuit 100 through an A/D converter (unshown) and feeds an output corresponding to the detected temperature to the control circuit 100.

The control circuit 100 comprises a circuit including a CPU operating for various controls, and a non-volatilization medium such as a ROM storing various programs. The programs are stored in the ROM, and the CPU reads and executes them to effect the various controls. The control circuit 100 may be an integrated circuit such as ASIC if it is capable of performing the similar operation.

As shown in FIG. 5, the control circuit 100 is electrically connected with the voltage source 110 so as to control is electric power supply from the voltage source 110. The control circuit 100 is electrically connected with the thermister 630 to receive the output of the thermister 630.

The control circuit 100 uses the temperature information acquired from the thermister 630 for the electric power supply control for the voltage source 110. More particularly, the control circuit 100 controls the electric power to the heater 600 through the voltage source 110 on the basis of the output of the thermister 630. In this embodiment, the control circuit 100 carries out a wave number control of the output of the voltage source 110 to adjust an amount of heat generation of the heater 600. By such a control, the heater 600 is maintained at a predetermined temperature (approx. 180 degree C., for example).

As shown in FIG. 3, the metal core 71 of the roller 70 is rotatably held by bearings 41*a* and 41*b* provided in a rear side and a front side of the side plate 41, respectively. One axial end of the metal core 71 is provided with a gear G to transmit the driving force from a motor M to the metal core 71 of the roller 70. As shown in FIG. 2, the roller 70 receiving the driving force from the motor M rotates in the direction indicated by the arrow (clockwise direction). In the nip N, the driving force is transmitted to the belt 603 by the way of the roller 70, so that the belt 603 is rotated in the direction indicated by the arrow (counterclockwise direction).

The motor M is a driving portion for driving the roller 70 through the gear G. As shown in FIG. 5, the control circuit 100 is electrically connected with the motor M to control the electric power supply to the motor M. When the electric energy is supplied by the control of the control circuit 100, the motor M starts to rotate the gear G.

The control circuit 100 controls the rotation of the motor M. The control circuit 100 rotates the roller 70 and the belt 603 using the motor M at a predetermined speed. It controls the motor so that the speed of the sheet P nipped and fed by the nip N in the fixing process operation is the same as a predetermined process speed (approx. 200 [mm/sec], for example).

[Heater]

Figure 4:
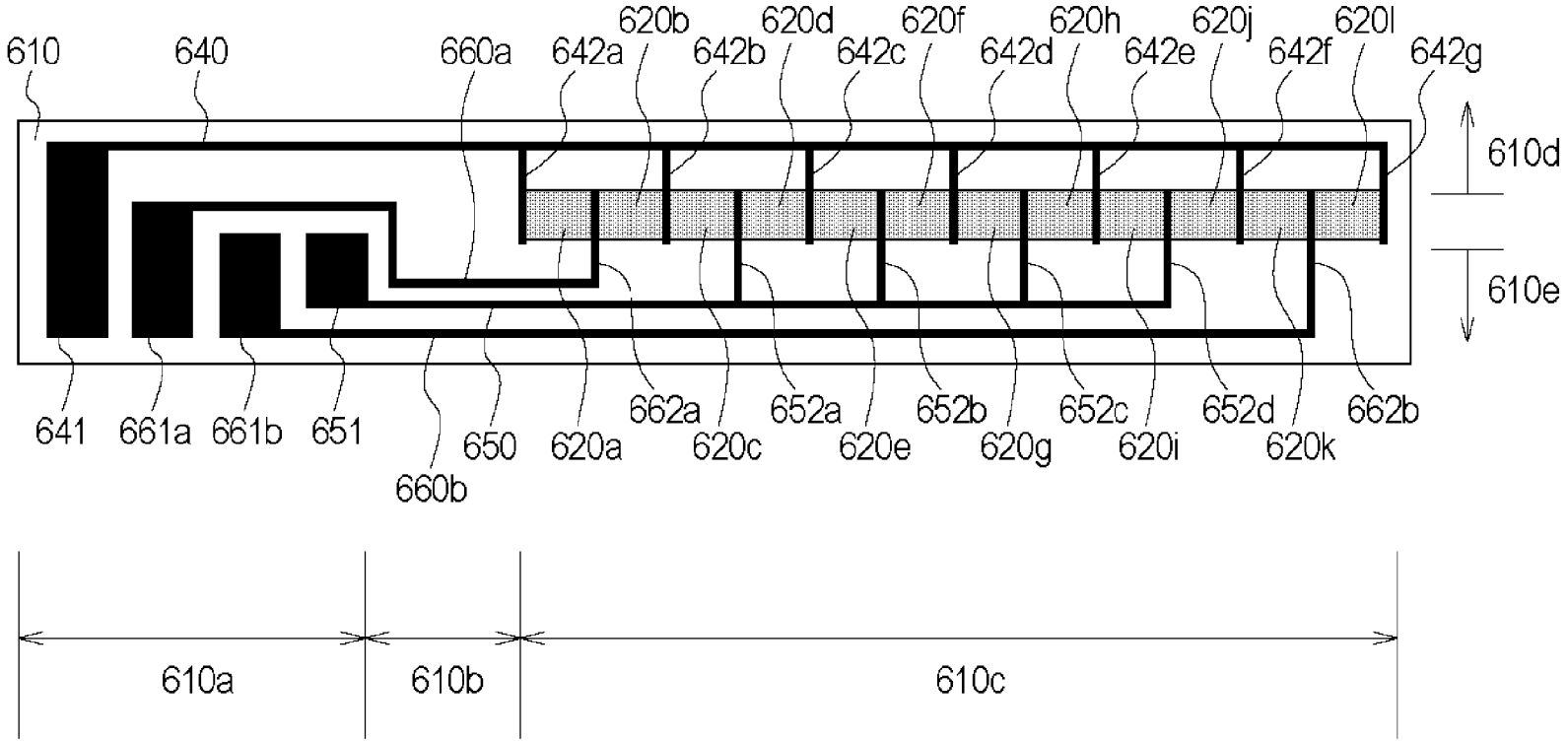
FIG. 4 illustrates a structure of a heater Embodiment 1.
Figure 6:
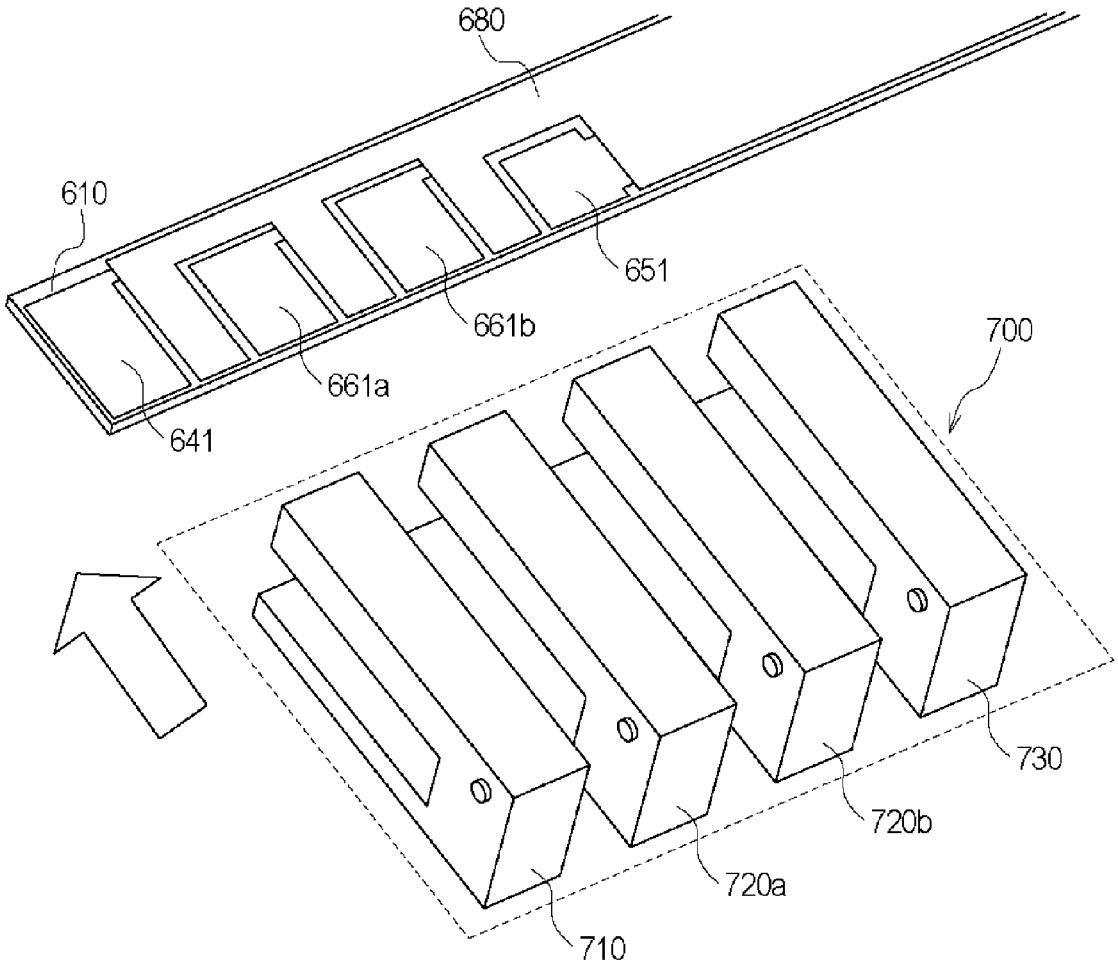
FIG. 6 illustrates a connector.
Figure 11:
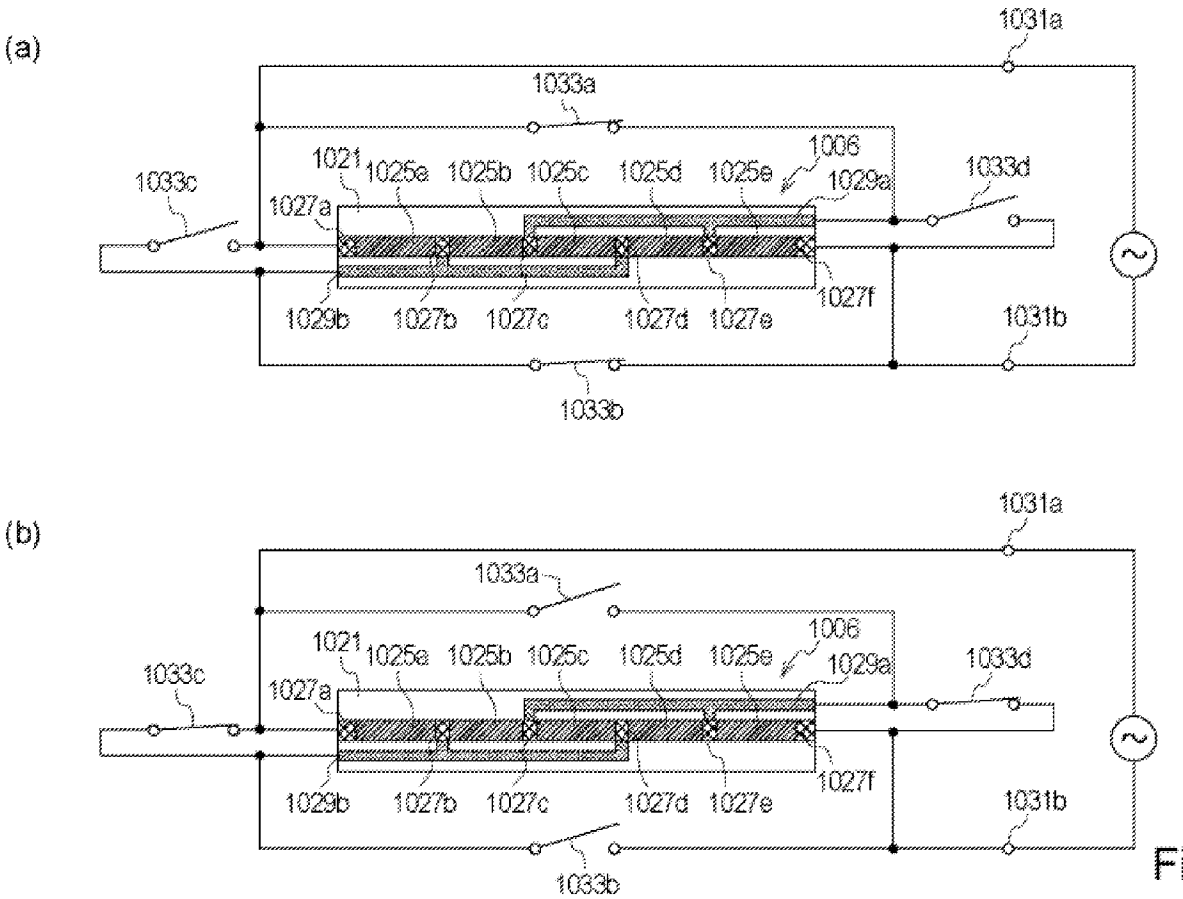
FIG. 11 is a circuit diagram of a conventional heater.

The structure of the heater 600 used in the fixing device 40 will be described in detail. FIG. 4 illustrates a structure of a heater Embodiment 1. FIG. 6 illustrates a connector. Part (a) of FIG. 11 illustrates a heat generating type used in the heater 600. Part (b) of FIG. 11 illustrates a heat generating region switching type used with the heater 600.

The heater 600 of this embodiment is a heater using the heat generating type shown in parts (a) and (b) of FIG. 11. As shown in part (a) of FIG. 11, electrodes A-C are electrically connected with the A-electroconductive-line, and electrodes D-F are electrically connected with B-electroconductive-line. The electrodes connected with the A-electroconductive-lines and the electrodes connected with the B-electroconductive-lines are interlaced (alternately arranged) along the longitudinal direction (left-right direction in part (a) of FIG. 11), and heat generating elements are electrically connected between the adjacent electrodes. When a voltage V is applied between the A-electroconductive-line and the B-electroconductive-line, a potential difference is generated between the adjacent electrodes. As a result, electric currents flow through the heat generating elements, and the directions of the electric currents through the adjacent heat generating elements are opposite to each other. In this type of heater, the heat is generated in the above-described the manner. As shown in part (b) of FIG. 11, between the B-electroconductive-line and the electrode F, a switch or the like is provided, and when the switch is opened, the electrode B and the electrode C are at the same potential, and therefore, no electric current flows through the heat generating element therebetween. In this system, the heat generating elements arranged in the longitudinal direction are independently energized so that only a part of the heat generating elements can be energized by switching a part off. In other words, in the system, the heat generating region can be changed by providing a switch or the like in the electroconductive line. In the heater 600, the heat generating region of the heat generating element 620 can be changed using the above-described system.

The heat generating element generates heat when energized, irrespective of the direction of the electric current, but it is preferable that the heat generating elements and the electrodes are arranged so that the currents flow along the longitudinal direction. Such an arrangement is advantageous over the arrangement in which the directions of the electric currents are in the widthwise direction perpendicular to the longitudinal direction (up-down direction in part (a) of FIG. 11) in the following point. When joule heat generation is effected by the electric energization of the heat generating element, the heat generating element generates heat correspondingly to the resistance value thereof, and therefore, the dimension and the material of the heat generating element are selected in accordance with the direction of the electric current so that the resistance value is at a desired level. The dimension of the substrate on which the heat generating element is provided is very short in the widthwise direction as compared with that in the longitudinal direction. Therefore, if the electric current which flows in the widthwise direction, it is difficult to provide the heat generating element with a desired resistance value, using a low resistance material. On the other hand, when the electric current flows in the longitudinal direction, it is relatively easy to provide the heat generating element with a desired resistance value, using the low resistance material. In addition, when a high resistance material is used for the heat generating element, a temperature non-uniformity may result from non-uniformity in the thickness of the heat generating element when it is energized. For example, when the heat generating element material is applied on the substrate along the longitudinal direction by screen printing or like, a thickness non-uniformity of about 5% may result in the widthwise direction. This is because a heat generating element material painting non-uniformity occurs due to a small pressure difference in the widthwise direction by a painting blade. For this reason, it is preferable that the heat generating elements and the electrodes are arranged so that the electric currents flow in the longitudinal direction.

In the case that the electric power is supplied individually to the heat generating elements arranged in the longitudinal direction, it is preferable that the electrodes and the heat generating elements are disposed such that the directions of the electric current flow alternates between adjacent ones. As to the arrangements of the heat generating members and the electrodes, it would be considered to arrange the heat generating elements each connected with the electrodes at the opposite ends thereof, in the longitudinal direction, and the electric power is supplied in the longitudinal direction. However, with such an arrangement, two electrodes are provided between adjacent heat generating elements, with the result of the likelihood of a short circuit. In addition, the number of required electrodes is large with the result of a large non-heat generating portion. Therefore, it is preferable to arrange the heat generating elements and the electrodes such that an electrode is made common between adjacent heat generating elements. With such an arrangement, the likelihood of the short circuit between the electrodes can be avoided, and the non-heat generating portion can be made small.

In this embodiment, a common electroconductive line 640 corresponds to A-electroconductive-line of part (a) of FIG. 12, and opposite electroconductive lines 650, 660*a*, 660*b* correspond to B-electroconductive-line. In addition, common electrodes 652*a*-652*g* correspond to electrodes A-C of part (a) of FIG. 12, and opposite electrodes 652*a*-652*d*, 662*a*, 662*b* correspond to electrodes D-F. Heat generating elements 620*a*-620*l* correspond to the heat generating elements of part (a) of FIG. 12. Hereinafter, the common electrodes 642*a*-642*g* are simply common electrode 642. The opposite electrodes 652*a*-652*d* are simply called opposite electrode 652. The opposite electrodes 662*a*-662*b* are simply called opposite electrode 662. The opposite electroconductive lines 660*a*, 660*b* are simply called opposite electroconductive line 660. The heat generating elements 620*a*-620*l* are simply called heat generating element 620. The structure of the heater 600 will be described in detail referring to the accompanying drawings.

As shown in FIGS. 4 and 6, the heater 600 comprises the substrate 610, the heat generating element 620 on the substrate 610, an electroconductor pattern (electroconductive line), and an insulation coating layer 680 covering the heat generating element 620 and the electroconductor pattern.

The substrate 610 determines the dimensions and the configuration of the heater 600 and is contactable to the belt 603 along the longitudinal direction of the substrate 610. The material of the substrate 610 is a ceramic material such as alumina, aluminum nitride or the like, which has high heat resistivity, thermo-conductivity, electrical insulative property or the like. In this embodiment, the substrate is a plate member of alumina having a length (measured in the left-right direction in FIG. 4) of approx. 400 mm, a width (up-down direction in FIG. 4) of approx. 10 mm and a thickness of approx. 1 mm.

On the back side of the substrate 610, the heat generating element 620 and the electroconductor pattern (electroconductive line) are provided through thick film printing method (screen printing method) using an electroconductive thick film paste. In this embodiment, a silver paste is used for the electroconductor pattern so that the resistivity is low, and a silver-palladium alloy paste is used for the heat generating element 620 so that the resistivity is high. As shown in FIG. 6, the heat generating element 620 and the electroconductor pattern coated with the insulation coating layer 680 of heat resistive glass so that they are electrically protected from leakage and short circuit.

As shown in FIG. 4, there are provided electrical contacts 641, 651, 661*a*, 661*b* as a part of the electroconductor pattern in one end portion side of the substrate 610 with respect to the longitudinal direction. In addition, there are provided the heat generating element 620 common electrodes 642*a*-642*g* and opposite electrodes 652*a*-652*d*, 662*a*-662*b* as a part of the electroconductor pattern in the other end portion side of the substrate 610 with respect to the longitudinal direction of the substrate 610. Between the one end portion side 610*a* of the substrate and the other end portion side 610*c*, there is a middle region 610*b*. In one end portion side 610*d* of substrate 610 beyond the heat generating element 620 with respect to the widthwise direction, the common electroconductive line 640 as a part of the electroconductor pattern is provided. In the other end portion side 610*e* of the substrate 610 beyond the heat generating element 620 with respect to the widthwise direction, the opposite electroconductive lines 650 and 660 are provided as a part of the electroconductor pattern.

The heat generating element 620 (620*a*-620*l*) as a plurality of heat generating portions is a resistor capable of generating joule heat by electric power supply (energization). The heat generating element 620 is one heat generating element member extending in the longitudinal direction on the substrate 610, and is disposed in the region 610*c* (FIG. 4) adjacent to the center portion of the substrate 610. The heat generating element 620 has a desired resistance value, and has a width (measured in the widthwise direction of the substrate 610) of 1-4 mm, a thickness of 5-20 μm. The heat generating element 620 in this embodiment has the width of approx. 2 mm and the thickness of approx. 10 μm. A total length of the heat generating element 620 in the longitudinal direction is approx. 320 mm, which is enough to cover a width of the A4 size sheet P (approx. 297 mm in width).

On the heat generating element 620, seven common electrodes 642*a*-642*g* which will be described hereinafter are laminated with intervals in the longitudinal direction. In other words, the heat generating element 620 is isolated into six sections by common electrodes 642*a*-642*g* along the longitudinal direction. The lengths measured in the longitudinal direction of the substrate 610 of each section are approx. 53.3 mm. On central portions of the respective sections of the heat generating element 620, one of the six opposite electrodes 652, 662 (652*a*-652*d*, 662*a*, 662*b*) are laminated. In this manner, the heat generating element 620 is divided into 12 sub-sections. The heat generating element 620 divided into 12 sub-sections can be deemed as a plurality of heat generating elements 620*a*-620*l*. In other words, the heat generating elements 620*a*-620*l* electrically connect adjacent electrodes with each other. Lengths of the sub-section measured in the longitudinal direction of the substrate 610 are approx. 26.7 mm. Resistance values of the sub-section of the heat generating element 620 with respect to the longitudinal direction are approx. 120Ω. With such a structure, the heat generating element 620 is capable of generating heat in a partial area or areas with respect to the longitudinal direction.

The resistivities of the heat generating elements 620 with respect to the longitudinal direction are uniform, and the heat generating elements 620*a*-620*l* have substantially the same dimensions. Therefore, the resistance values of the heat generating elements 620*a*-620*l* are substantially equal. When they are supplied with electric power in parallel, the heat generation distribution of the heat generating element 620 is uniform. However, it is not inevitable that the heat generating elements 620*a*-620*l* have substantially the same dimensions and/or substantially the same resistivities. For example, the resistance values of the heat generating elements 620*a* and 620*l* may be relatively smaller so as to prevent temperature lowering at the longitudinal end portions of the heat generating element 620. At the positions of the heat generating element 620 where the common electrode 642 and the opposite electrodes 652, 662 are provided, the heat generation of the heat generating element 620 is substantially zero. However, the heat uniforming function of the substrate 610 makes the influence on the fixing process negligible if the width of the electrode is not more than 1 mm, for example. In this embodiment, the width of each electrode is not more than 1 mm.

The common electrodes 642 (642*a*-642*g*) are a part of the above-described electroconductor pattern. The common electrode 642 extends in the widthwise direction of the substrate 610 perpendicular to the longitudinal direction of the heat generating element 620. In this embodiment, the common electrode 642 is laminated on the heat generating element 620. The common electrodes 642 are odd-numbered electrodes of the electrodes connected to the heat generating element 620, as counted from a one longitudinal end of the heat generating element 620. The common electrode 642 is connected to one contact 110*a* of the voltage source 110 through the common electroconductive line 640 which will be described hereinafter.

The opposite electrodes 652, 662 are a part of the above-described electroconductor pattern. The opposite electrodes 652, 662 extend in the widthwise direction of the substrate 610 perpendicular to the longitudinal direction of the heat generating element 620. The opposite electrodes 652, 662 are the other electrodes of the electrodes connected with the heat generating element 620 other than the above-described common electrode 642. That is, in this embodiment, they are even-numbered electrodes as counted from the one longitudinal end of the heat generating element 620.

That is, the common electrode 642 and the opposite electrodes 662, 652 are alternately arranged along the longitudinal direction of the heat generating element. The opposite electrodes 652, 662 are connected to the other contact 110*b* of the voltage source 110 through the opposite electroconductive lines 650, 660 which will be described hereinafter.

The common electrode 642 and the opposite electrodes 652, 662 function as a plurality of electrode portions for supplying the electric power to the heat generating element 620. In this embodiment, the odd-numbered electrodes are common electrodes 642, and the even-numbered electrodes are opposite electrodes 652, 662, but the structure of the heater 600 is not limited to this example. For example, the even-numbered electrodes may be the common electrodes 642, and the odd-numbered electrodes may be the opposite electrodes 652, 662.

In addition, in this embodiment, four of the all opposite electrodes connected with the heat generating element 620 are the opposite electrode 652. In this embodiment, two of the all opposite electrodes connected with the heat generating element 620 are the opposite electrode 662. However, the allotment of the opposite electrodes is not limited to this example, but may be changed depending on the heat generation widths of the heater 600. For example, two may be the opposite electrode 652, and four maybe the opposite electrode 662.

The common electroconductive line 640 is a part of the above-described electroconductor pattern. The common electroconductive line 640 extends along the longitudinal direction of the substrate 610 toward the one end portion side 610*a* of the substrate in the one end portion side 610*d* of the substrate. The common electroconductive line 640 is connected with the common electrodes 642 (642*a*-642*g*) which is in turn connected with the heat generating element 620 (620*a*-620*l*). The common electroconductive line 640 is connected to the electrical contact 641 which will be described hereinafter. In this embodiment, in order to assure the insulation of the insulation coating layer 680, a gap of approx. 400 μm is provided between the common electroconductive line 640 and each opposite electrode.

The opposite electroconductive line 650 is a part of the above-described electroconductor pattern. The opposite electroconductive line 650 extends along the longitudinal direction of substrate 610 toward the one end portion side 610*a* of the substrate in the other end portion side 610*e* of the substrate. The opposite electroconductive line 650 is connected with the opposite electrodes 652 (652*a*-652*d*) which are in turn connected with heat generating elements 620 (620*c*-620*j*). The opposite electroconductive line 650 is connected to the electrical contact 651 which will be described hereinafter.

The opposite electroconductive line 660 (660*a*, 660*b*) is a part of the above-described electroconductor pattern. The opposite electroconductive line 660*a* extends along the longitudinal direction of substrate 610 toward the one end portion side 610*a* of the substrate in the other end portion side 610*e* of the substrate. The opposite electroconductive line 660*a* is connected with the opposite electrode 662*a* which is in turn connected with the heat generating element 620 (620*a*, 620*b*). The opposite electroconductive line 660*a* is connected to the electrical contact 661*a* which will be described hereinafter. The opposite electroconductive line 660*b* extends along the longitudinal direction of substrate 610 toward the one end portion side 610*a* of the substrate in the other end portion side 610*e* of the substrate. The opposite electroconductive line 660*b* is connected with the opposite electrode 662*b* which is in turn connected with the heat generating element 620. The opposite electroconductive line 660*b* is connected to the electrical contact 661*b* which will be described hereinafter. In this embodiment, in order to assure the insulation of the insulation coating layer 680, a gap of approx. 400 μm is provided between the opposite electroconductive line 660*a* and the common electrode 642. In addition, between the opposite electroconductive lines 660*a* and 650 and between the opposite electroconductive lines 600*b* and 650, gaps of approx. 100 μm are provided.

The electrical contacts 641, 651, 661 (661*a*, 661*b*) are a part of the above-described electroconductor pattern. Each of the electrical contacts 641, 651, 661 preferably has an area of not less than 2.5 mm×2.5 mm in order to assure the reception of the electric power supply from the connector 700 which will be described hereinafter. In this embodiment, the electrical contacts 641, 651, 661 have a length of approx. 3 mm measured in the longitudinal direction of the substrate 610 and a width of not less than 2.5 mm measured in the widthwise direction of the substrate 610. The electrical contact disposed closer to the outside with respect to the longitudinal direction of the substrate 610 has a relatively larger width measured in the widthwise direction. Therefore, the electrical contact 641 has a widthwise direction dimension which is larger than those of the electrical contacts 651, 661. The electrical contact 661*a* has a widthwise direction dimension which is larger than those of the electrical contacts 651, 661*b*. The electrical contact 661*b* has a widthwise direction dimension which is larger than that of the electrical contact 651.

By this configuration, the electrical insulation is assured between the electrical contacts 641, 651, 661 and the electroconductive lines 640, 650, 660. The widthwise direction dimensions of the electrical contacts may be the same, but in such a case, spaces are required to avoid the interference with the result of prolonged widthwise direction dimension of the substrate 610. In other words, the above-described structure is effective to reduce the widthwise direction dimension of the substrate in this embodiment. In addition, the size of the electrical contact is large where the current therethrough is large. In this embodiment, the electrical contact 641 of the electrical contacts 641, 651, 661 that are connected with the largest number of heat generating elements has the largest widthwise direction dimension. That is, the electrical contact 641 is replaced in the outside most position of the substrate with respect to the longitudinal direction.

The electrical contacts 641, 651, 661*a*, 661*b* are disposed in the one end portion side 610*a* of the substrate beyond the heat generating element 620 with gaps of approx. 4 mm in the longitudinal direction of the substrate 610. As shown in FIG. 6, no insulation coating layer 680 is provided at the positions of the electrical contacts 641, 651, 661*a*, 661*b* so that the electrical contacts are exposed. The electrical contacts 641, 651, 661*a*, 661*b* are exposed concentrically on a region 610*a* which is projected beyond an edge of the belt 603 with respect to the longitudinal direction of the substrate 610. Therefore, the electrical contacts 641, 651, 661*a*, 661*b* are contactable to the connector 700 to establish electrical connection therewith.

When voltage is applied between the electrical contact 641 and the electrical contact 651 through the connection between the heater 600 and the connector 700, a potential difference is produced between the common electrode 642 (642*b*-642*f*) and the opposite electrode 652 (652*a*-652*d*). Therefore, through the heat generating elements 620*c*, 620*d*, 620*e*, 620*f*, 620*g*, 620*h*, 620*i*, 620*j*, the currents flow along the longitudinal direction of the substrate 610, the directions of the currents through the adjacent heat generating elements being substantially opposite to each other. The heat generating elements 620*c*, 620*d*, 620*e*, 620*f*, 620*g*, 620*h*, 620*i* as a first heat generating region generate heat, respectively.

When voltage is applied between the electrical contact 641 and the electrical contact 661*a* through the connection between the heater 600 and the connector 700, a potential difference is produced between the common electrode 642 and the opposite electrode 662*a* through the common electroconductive line 640 and the opposite electroconductive line 660*a*. Therefore, through the heat generating elements 620*a*, 620*b*, the currents flow along the longitudinal direction of the substrate 610, the directions of the currents through the adjacent heat generating elements being opposite to each other. The heat generating elements 620*a*, 620*b* form a second heat generating region adjacent the first heat generating region generate heat.

When voltage is applied between the electrical contact 641 and the electrical contact 661*b* through the connection between the heater 600 and the connector 700, a potential difference is produced between the common electrode 642 and the opposite electrode 662*b* through the common electroconductive line 640 and the opposite electroconductive line 660*b*. Therefore, through the heat generating elements 620*k*, 620*l*, the currents flow along the longitudinal direction of the substrate 610, the directions of the currents through the adjacent heat generating elements being opposite to each other. By this, the heat generating elements 620*k*, 620*l* form a third heat generating region adjacent to the first heat generating region generate heat.

In this manner, by selecting the electrical contacts supplied with the voltage, the desired one or ones of the heat generating elements 620*a*-620*l* can be selectively energized.

Between the one end portion side 610*a* of the substrate and the other end portion side 610*c*, there is a middle region 610*b*. More particularly, in this embodiment, the region between the common electrode 642*a* and the electrical contact 651 is the middle region 610*b*. The middle region 610*b* is a marginal area for permitting mounting of the connector 700 to the heater 600 placed inside the belt 603. In this embodiment, the middle region is approx. 26 mm. This is sufficiently larger than the distance required for insulating the common electrode 642*a* and the electrical contact from each other.

[Connector]

Figure 7:
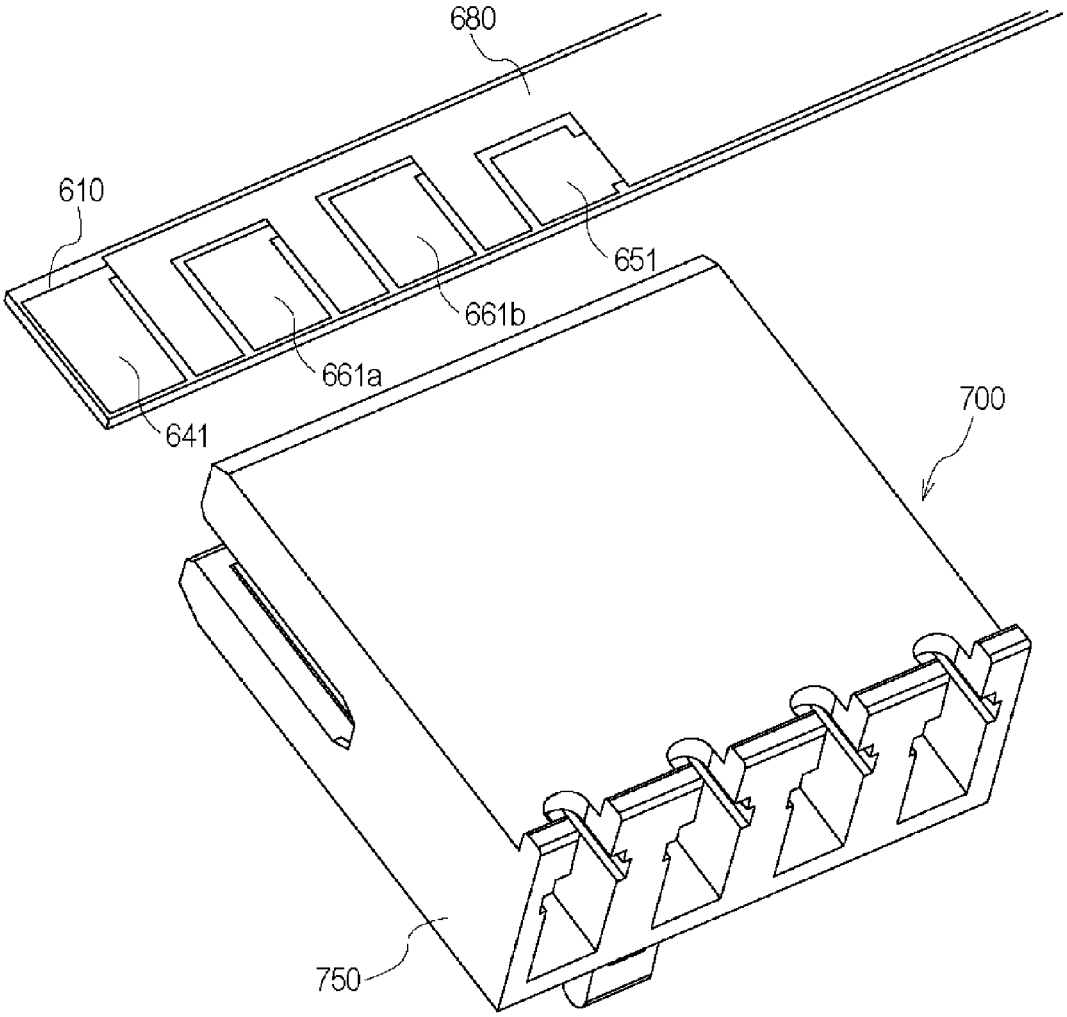
FIG. 7 illustrates a housing.
Figure 8:
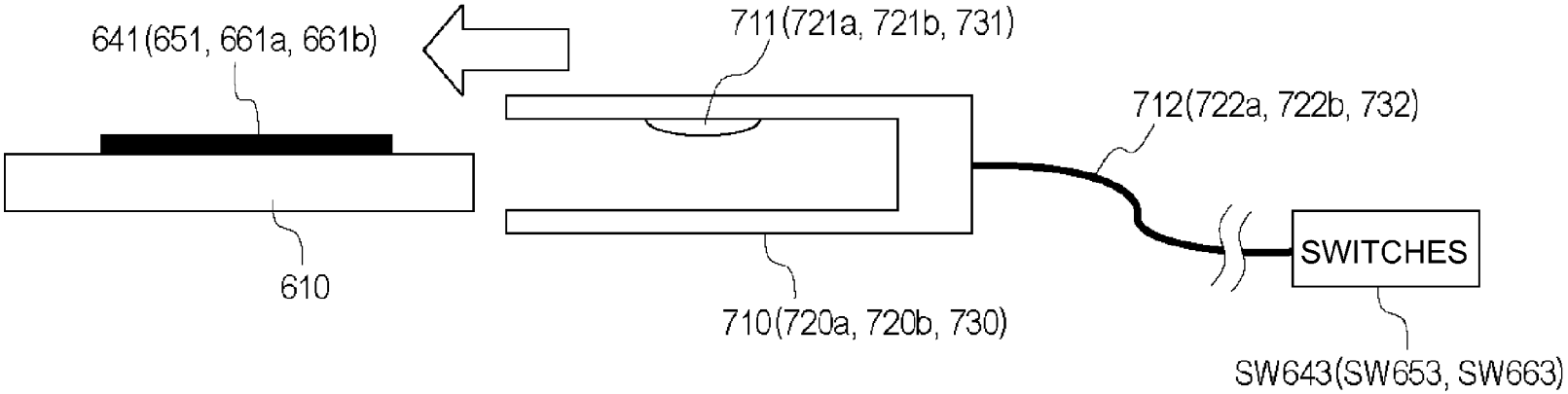
FIG. 8 illustrates a contact terminal.

The connector 700 used with the fixing device 40 will be described in detail. FIG. 7 is an illustration of a housing 750. FIG. 8 is an illustration of a contact terminal 710. The connector 700 of this embodiment is electrically connected with the heater 600 by mounting to the heater 600. The connector 700 comprises a contact terminal 710 electrically connectable with the electrical contact 641, and a contact terminal 730 electrically connectable with the electrical contact 651. It also comprises a contact terminal 720*a* electrically connectable with the electrical contact 661*a*, and a contact terminal 720*b* electrically connectable with the electrical contact 661*b*. The connector 700 sandwiches a region of the heater 600 extending out of the belt 603 so as not to contact with the belt 603, by which the contact terminals are electrically connected with the electrical contacts, respectively. In the fixing device 40 of this embodiment having the above-described the structures, no soldering or the like is used for the electrical connection between the connectors and the electrical contacts. Therefore, the electrical connection between the heater 600 and the connector 700 rise in temperature during the fixing process operation, can be accomplished and maintained with high reliability. In the fixing device 40 of this embodiment, the connector 700 is detachably mountable relative to the heater 600, and therefore, the belt 603 and/or the heater 600 can be replaced without difficulty. The structure of the connector 700 will be described in detail.

As shown in FIG. 6, the connector 700 provided with the metal contact terminals 710, 720*a*, 720*b*, 730 is mounted to the heater 600 in the widthwise direction of the substrate 610 at one end portion side 610*a* of the substrate. The contact terminals 710, 720*a*, 720*b*, 730 will be described, taking the contact terminal 710 for instance. As shown in FIG. 8, the contact terminal 710 functions to electrically connect the electrical contact 641 to a switch SW643 which will be described hereinafter. The contact terminal 710 is provided with a cable 712 for the electrical connection between the switch SW643 and the electrical contact 711 for contacting to the electrical contact 641. The contact terminal 710 has a channel-like configuration, and by moving in the direction indicated by an arrow in FIG. 8, it can receive the heater 600. The portion of the contact terminal 710 which contacts the electrical contact 641 is provided with the electrical contact 711 which contacts the electrical contact 641, by which the electrical connection is established between the electrical contact 641 and the contact terminal 710. The electrical contact 711 has a leaf spring property, and therefore, contacts the electrical contact 641 while pressing against it. Therefore, the contact 710 sandwiches the heater 600 between the front and back sides to fix the position of the heater 600.

Similarly, the contact terminal 720*a* functions to contact the electrical contact 661*a* with the switch SW663 which will be described hereinafter. The contact terminal 720*a* is provided with a cable 721*a* for the electrical connection between the switch SW663 and the electrical contact 721*a* (FIG. 8) for contacting to the electrical contact 661.

Similarly, the contact terminal 720*b* functions to contact the electrical contact 661*b* with the switch SW663 which will be described hereinafter. The contact terminal 720*b* is provided with a cable 732*b* (FIG. 8) for the electrical connection between the switch SW643 and the electrical contact 721*b* for contacting to the electrical contact 661.

Similarly, the contact terminal 730 functions to contact the electrical contact 651 with the switch SW653 which will be described hereinafter. The contact terminal 730 is provided with a cable 722 (FIG. 8) for the electrical connection between the switch SW643 and the electrical contact 731 (FIG. 8) for contacting to the electrical contact 641.

As shown in FIG. 7, the contact terminals 710, 720*a*, 720*b*, 730 of metal are integrally supported on the housing 750 of resin material. The contact terminals 710, 720*a*, 720*b*, 730 are provided in the housing 750 with spaces between adjacent ones so as to be connectable with the electrical contacts 641, 661*a*, 661*b*, 651, respectively when the connector 700 is mounted to the heater 600. Between adjacent contact terminals, partitions are provided to electrically insulate between the adjacent contact terminals.

In this embodiment, the connector 700 is mounted in the widthwise direction of the substrate 610, but this mounting method is not limiting to the present invention. For example, the structure may be such that the connector 700 is mounted in the longitudinal direction of the substrate.

[Electric Energy Supply to Heater]

An electric energy supply method to the heater 600 will be described. The fixing device 40 of this embodiment is capable of changing a width of the heat generating region of the heater 600 by controlling the electric energy supply to the heater 600 in accordance with the width size of the sheet P. With such a structure, the heat can be efficiently supplied to the sheet P. In the fixing device 40 of this embodiment, the sheet P is fed with the center of the sheet P aligned with the center of the fixing device 40, and therefore, the heat generating region extends from the center portion. The electric energy supply to the heater 600 will be described in conjunction with the accompanying drawings.

The voltage source 110 is a circuit for supplying the electric power to the heater 600. In this embodiment, the commercial voltage source (AC voltage source) is approx. 100V in effective value (single phase AC). The voltage source 110 of this embodiment is provided with a voltage source contact 110*a* and a voltage source contact 110*b* having different electric potential. The voltage source 110 may be DC voltage source if it has a function of supplying the electric power to the heater 600.

As shown in FIG. 5, the control circuit 100 is electrically connected with switch SW643, switch SW653, and switch SW663, respectively to control the switch SW643, switch SW653, and switch SW663, respectively.

Switch SW643 is a switch (relay) provided between the voltage source contact 110*a* and the electrical contact 641. The switch SW643 connects or disconnects between the voltage source contact 110*a* and the electrical contact 641 in accordance with the instructions from the control circuit 100. The switch SW653 is a switch provided between the voltage source contact 110*b* and the electrical contact 651. The switch SW653 connects or disconnects between the voltage source contact 110*b* and the electrical contact 651 in accordance with the instructions from the control circuit 100. The switch SW663 is a switch provided between the voltage source contact 110*b* and the electrical contact 661 (661*a*, 661*b*). The switch SW663 connects or disconnects between the voltage source contact 110*b* and the electrical contact 661 (661*a*, 661*b*) in accordance with the instructions from the control circuit 100.

When the control circuit 100 receives the execution instructions of a job, the control circuit 100 acquires the width size information of the sheet P to be subjected to the fixing process. In accordance with the width size information of the sheet P, a combination of ON/OFF of the switch SW643, switch SW653, switch SW663 is controlled so that the heat generation width of the heat generating element 620 fits the sheet P. At this time, the control circuit 100, the voltage source 110, switch SW643, switch SW653, and switch SW663 function as an electric energy supplying portion for supplying the electric power to the heater 600 through the connector 700.

When the sheet P is a large size sheet (an usable maximum width size), that is, when A3 size sheet is fed in the longitudinal direction or when the A4 size is fed in the landscape fashion, the width of the sheet P is approx. 297 mm. Therefore, the control circuit 100 controls the electric power supply to provide the heat generation width B (FIG. 5) of the heat generating element 620. To affect this, the control circuit 100 renders ON all of the switches, that is, switch SW643, switch SW653, and switch SW663. As a result, the heater 600 is supplied with the electric power through the electrical contacts 641, 661*a*, 661*b*, 651 as a first electrical contact group, and all of the 12 sub-sections of the heat generating element 620 generate heat. At this time, the heater 600 generates the heat uniformly over the approx. 320 mm region to meet the approx. 297 mm sheet P.

When the size of the sheet P is a small size (narrower than the maximum width), that is, when an A4 size sheet is fed longitudinally, or when an A5 size sheet is fed in the landscape fashion, the width of the sheet P is approx. 210 mm. Therefore, the control circuit 100 provides a heat generation width A (FIG. 5) of the heat generating element 620. Therefore, the control circuit 100 renders ON the switch SW643 and switch SW653, and renders OFF the switch SW663. As a result, the heater 600 is supplied with the electric power through the electrical contacts 641, 651 as a second electric energy supplying portion, so that only 8 sub-sections of the 12 sub-sections of the heat generating element 620 generate heat. At this time, the heater 600 generates the heat uniformly over the approx. 213 mm region to meet the approx. 210 mm sheet P.

As described hereinbefore, the first electrical contact group and the second electrical contact group are partly (electrical contacts (641, 651)) common.

As described hereinbefore, in the fixing device 40 of this embodiment, the heater 600 is supplied with the electric power through the single connector 700 at one end portion side of the heater 600 with respect to the longitudinal direction. In other words, connector 700 is not provided at the other longitudinal end of the heater 600. Therefore, the marginal area of the substrate 610 for permitting the mounting of the connector 700 to the heater 600 is necessary only at one end portion. Therefore, the length of the substrate 610 is shorter than that when the connectors are provided at both end portions. In other words, the upsizing of the substrate 610 in the longitudinal direction which results from the mountability of the connector can be suppressed. Therefore, the manufacturing cost of the heater 600 can be reduced. A plurality of connectors may be used if they are provided at one end portion side of the heater with respect to the longitudinal direction. However, a single connector structure is preferable from the standpoint of easy mounting and demounting relative to the heater 600 with all together connection for the electrical contacts.

In this embodiment, the single electrical contact 641 is used as the electrical contact for connection with the voltage source contact 110*a*, but a plurality of electrical contacts for connection with the voltage source contact 110*a* may be used. However, the structure of this embodiment is preferable from the standpoint of suppressing the upsizing of the substrate.

Embodiment 2

A heater according to Embodiment 2 of the present invention will be described. FIG. 13 illustrates an illustration of the heater according to this embodiment. FIG. 14 is an illustration of structure relation of the fixing device 40 in this embodiment. In Embodiment 1, the electric energy supply to the heat generating element 620 is different from that disclosed in Japanese Laid-open Patent Application 2012-37613. On the other hand, in Embodiment 2, the electric energy supply method to the heat generating element 620 is different from the conventional example. More particularly, the electrical contacts connected with the electroconductive lines are concentratedly in one end portion side of the substrate, for the convenience of the electric power supply using the connector similar to that used in Embodiment 1. The description will be made in detail in conjunction with the accompanying drawings. The structure of the fixing device 40 of Embodiment 2 is fundamentally the same as the those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

As shown in FIG. 13, the heater 600 comprises a substrate 610, heat generating elements 1620*a*-1620*e* on the substrate 610, an electroconductor pattern (electroconductive line), and an insulation coating layer 680 coating them similarly to Embodiment 1. The heat generating elements 1620*a*-1620*e* are simply called heat generating element 1620.

As shown in FIG. 13, one longitudinal end portion 610*a* of the substrate 610 is provided with electrical contacts 1641, 1651, 1661, 1671 as a part of the electroconductor pattern. The other end portion side 610*c* of the substrate 610 is provided with the heat generating element 620 and electrodes 1642, 1652*a* 1652*b*, 1662*a*, 1662*b*, 1672 as a part of the electroconductor pattern. Between the one end portion side of the substrate and the other end portion side 610*c*, a middle region 610*b* is provided.

On the substrate 610, there are provided electroconductive lines 1640, 1650, 1660, 1670 as a part of the electroconductor pattern, extending beyond the middle region 610*b*.

The heat generating element 1620 is a resistor which reduces joule heat by electric power supply thereto. A total length of the heat generating element 620 in the longitudinal direction is approx. 320 mm, which is enough to cover a width of the A4 size sheet P (approx. 297 mm in width).

The heat generating element 620 is isolated into five sections by six electrodes 1642, 1652*a*, 1652*b*, 1662*a*, 1662*b*, 1672 along the longitudinal direction. The lengths measured in the longitudinal direction of the substrate 610 of each section are approx. 64 mm. The heat generating element divided into five sections can be deemed as a plurality of heat generating elements 1620*a*-1620*e*.

The electrodes 1672, 1662*a*, 1662*b*, 1652*a*, 1652*b*, 1642 are a part of the above-described electroconductor pattern. The electrodes are arranged along the longitudinal direction of the heat generating element 620 and extend in the widthwise direction of the substrate 610 which is perpendicular to the longitudinal direction of the heat generating element 620.

Electrical contacts 1641, 1651, 1661, and 1671 are a part of the above-described electroconductor pattern. The electrical contacts 1641, 651, 1661, 1671 are disposed in one end portion side 610*a* of the substrate than the heat generating element 620 with gaps between the adjacent ones in the longitudinal direction of the substrate 610. The electrical contact 1641 is electrically connected with an electrode 1642 through the electroconductive line 1640. The electrical contact 1651 is electrically connected with electrodes 1652*a*, 1652*b* through the electroconductive line 1650. The electrical contact 1661 is electrically connected with electrodes 1662*a*, 1662*b* through the electroconductive line 1660. The electrical contact 1671 is electrically connected with an electrode 1672 through the electroconductive line 1670.

By connection of the electrical contacts with the connector (unshown), the heater 600 can be supplied with the electric power.

The voltage source 110 is a circuit for supplying the electric power to the heater 600.

SW1045, SW1046, SW1057, and SW1067 are switches (relays) provided between the voltage source 110 and the respective electrical contacts.

As shown in FIG. 14, a control circuit 100 is electrically connected with the switches SW1045, SW1046, SW1057, and SW1067 to control the switching operations of the switches SW1045, SW1046, SW1057, and SW1067, respectively.

Control circuit 100 controls the switching operations of the switches SW1045, SW1046, SW1057, and SW1067 in accordance with the width information of the sheet P so that the heat generation width of the heat generating element 620 fits the width of the sheet P.

When the sheet P is a large size sheet (an usable maximum width size), that is, when A3 size sheet is fed in the longitudinal direction or when the A4 size is fed in the landscape fashion, the width of the sheet P is approx. 297 mm. Therefore, the control circuit 100 controls the electric power supply to provide the heat generation width B (FIG. 14) of the heat generating element 620. Therefore, the control circuit 100 renders ON the switches SW1046 and SW1057, and renders OFF the switches SW1045 and SW1067. As a result, the electric power is supplied to the heat generating elements 1620*a*, 1620*b*, 1620*c*, 1620*d*, and 1620*e*. The heater 600 generates the heat uniformly over the approx. 320 mm region to meet the approx. 297 mm sheet P.

When the size of the sheet P is a small size (narrower than the maximum width), that is, when a B5 size sheet is fed longitudinally, or when a B6 size sheet is fed in the landscape fashion, the width of the sheet P is approx. 182 mm. Therefore, the control circuit 100 provides a heat generation width A (FIG. 5) of the heat generating element 620. Therefore, the control circuit 100 renders ON the switches SW1045 and SW1067, and renders OFF the switches SW1046 and SW1057. As a result, the heat generating elements 1620*b*, 1620*c*, 1620*d* are supplied with the electric power. The heater 600 generates the heat uniformly over the approx. 192 mm region to meet the approx. 182 mm sheet P.

As described hereinbefore, in the fixing device 40 of this embodiment, the heater 600 is supplied with the electric power through the single connector 700 at one end portion side of the heater 600 with respect to the longitudinal direction. In other words, connector 700 is not provided at the other longitudinal end of the heater 600. Therefore, the marginal area of the substrate 610 for permitting the mounting of the connector 700 to the heater 600 is necessary only at one end portion. Therefore, the length of the substrate 610 is shorter than that when the connectors are provided at both end portions. In other words, the upsizing of the substrate 610 in the longitudinal direction which results from the mountability of the connector can be suppressed. Therefore, the manufacturing cost of the heater 600 can be reduced.

Embodiment 3

Figure 9:
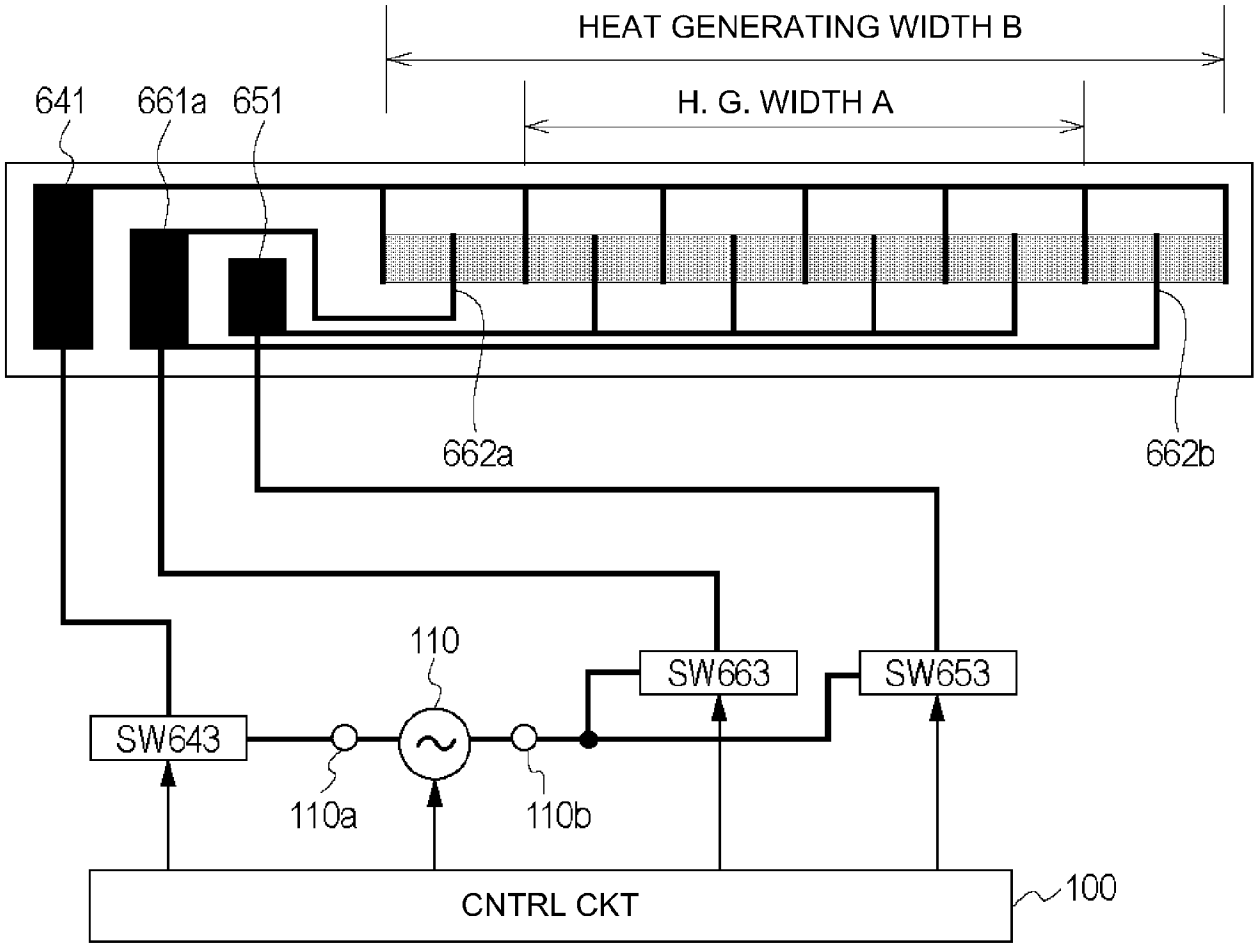
FIG. 9 illustrates the structural relationship of the image heating apparatus according to an Embodiment 3.

A heater according to Embodiment 3 of the present invention will be described. FIG. 9 is an illustration of a structure relation of the image heating apparatus of this embodiment. FIG. 12 is a circuit diagram of a conventional heater. In Embodiment 1, the electrical contacts 641, 651, 661*a*, 661*b* are used for the electric energy supply to the heat generating element 620. On the other hand, in Embodiment 3, the electrical contacts 641, 651, 661*a* are used for the electric energy supply to the heat generating element 620. More particularly, the electrical contact 661*b* and electrical contact 661*a* of Embodiment 1 are gathered into a common electrical contact 661*a*. With such a structure, the number of electrical contacts on the substrate 610 can be reduced. The description will be made in detail in conjunction with the accompanying drawings. The structures of the fixing device 40 of Embodiment 3 are fundamentally the same as those of Embodiment 1 except for the structures relating to the heater 600. In the description of this embodiment, the same reference numerals as in Embodiment 1 are assigned to the elements having the corresponding functions in this embodiment, and the detailed description thereof is omitted for simplicity.

As shown in FIG. 9, in the heater 600 of this embodiment, the heat generating element 620 is supplied with the electric power through the electrical contacts 641, 651, 661*a* provided in one end portion side of the substrate 610 with respect to the longitudinal direction.

The opposite electroconductive line 660*a* extends along the longitudinal direction of the substrate 610 toward the one end portion side 610*a* of the substrate in another end portion side with respect to the widthwise direction substrate 610 beyond the heat generating element 620. The end of the opposite electroconductive line 660*a* is connected with the electrical contact 661*a*. The opposite electroconductive line 660*b* extends along the longitudinal direction of the substrate 610 toward the one end portion side 610*a* of the substrate in another end portion side with respect to the widthwise direction substrate 610 beyond the heat generating element 620. The end of the opposite electroconductive line 660*b* is connected with the electrical contact 661*a*. The opposite electroconductive lines 660*a* and 660*b* surround the electrical contact 651*a* in the one end portion side of the substrate 610 with respect to the longitudinal direction. With such a structure, the electrical contact 661*a* can function as both of the electrical contacts 661*b* and 661*a* of Embodiment 1.

The electrical contacts 641, 651, 661*a* are disposed in the one end portion side 610*a* of the substrate with gaps of approx. 4 mm in the longitudinal direction of the substrate 610. As shown in FIG. 6, no insulation coating layer 680 is provided at the positions of the electrical contacts 641, 651, 661*a* so that the electrical contacts are exposed. Therefore, the electrical contacts 641, 651, 661*a* are contactable to the connector 700 to establish electrical connection therewith.

When the sheet P is a large size sheet (wide sheet), the control circuit 100 controls the heat generating element 620 so as to provide a heat generation width B (FIG. 5). As a result, the heater 600 is provided with the electric power through the electrical contacts 641, 661*a*, 651 as a first electric energy supplying portion, so that all of the 12 sub-sections of the heat generating element 620 generate heat.

When the sheet P is a small size sheet (narrow sheet), the control circuit 100 controls the heat generating element 620 so as to provide a heat generation width A (FIG. 5). As a result, the heater 600 is supplied with the electric power through the electrical contacts 641, 651, so that 8 sub-sections of the 12 sub-sections of the heat generating element 620 generate heat.

With this structure of this embodiment, one electrical contact (approx. 3 mm in width) and one gap between adjacent electrical contacts (approx. 4 mm) are omitted, and therefore, the length of the substrate 610 can be shortened by approx. 7 mm, as compared with Embodiment 1.

In other words, the upsizing of the substrate 610 which results from the mountability of the connector can be suppressed. Therefore, the manufacturing cost of the heater 600 can be reduced.

The fixing device 40 of this embodiment is operable with 2 patterns of the heat generating region (large and small), but this embodiment is applicable to a fixing device operable with 3 or more patterns of the heat generating region. In the case of three pattern heat generating region, for example, an additional electrical contact is provided in addition to the electrical contacts 641, 651, 661*a* without a change in the electric power supplied to the heat generating element 620. Thus, for n (integer) correspondence heat generation widths (two in this embodiment), the electric power can be supplied to the electric energy supply by n+1 electrical contacts (three in this embodiment).

As described in the foregoing, the heater 600 using the electric energy supply method of Embodiment 1 can use this embodiment. On the other hand, the heater 600 using the electric energy supply method of Embodiment 2 cannot easily use this embodiment, because the electrical contacts 1641, 1651, 1661, 1671 can connect with different voltage source contacts (1031*a* and 1031*b*)). That is, it is not easy to form a plurality of electrical contacts into a single electrical contact. Therefore, from the standpoint of suppressing the upsizing of the substrate 610 in the longitudinal direction, the electric energy supply method of Embodiment 1 is preferable to the electric energy supply method of Embodiment 2.

Embodiment 4

Figure 10:
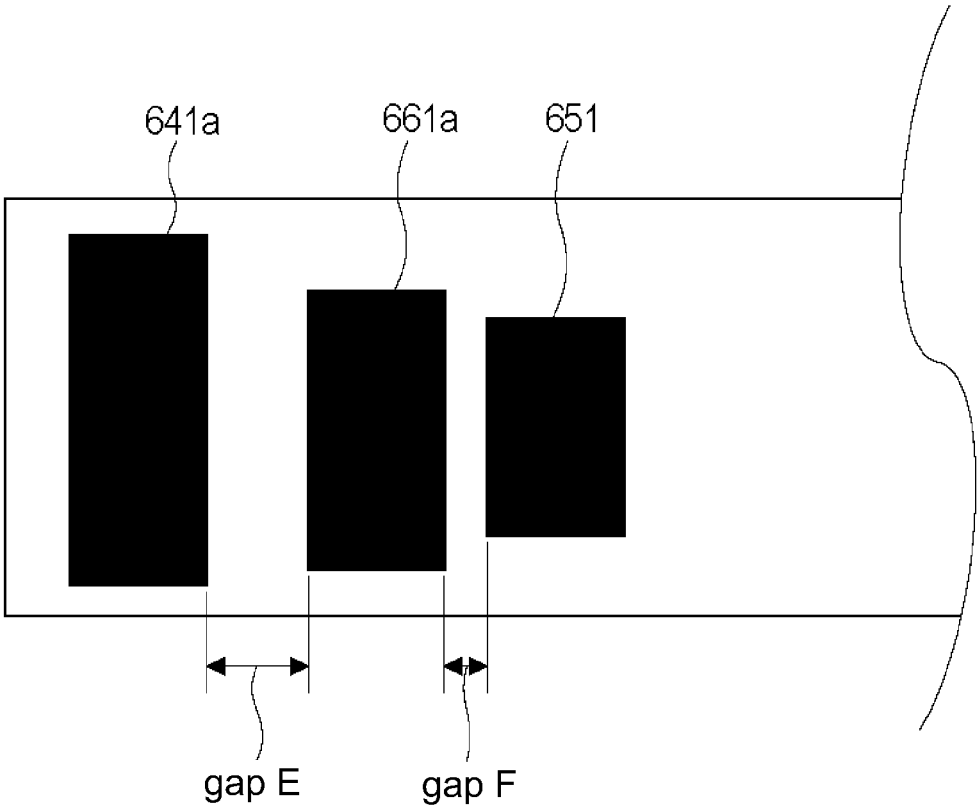
FIG. 10 illustrates an arrangement of electrical contacts in Embodiment 4.

A heater according to Embodiment 4 will be described. FIG. 10 is an illustration of arrangements of the electrical contacts in this embodiment. In Embodiment 3, in the one end portion side of the substrate 610 with respect to the longitudinal direction, the electrical contacts 641, 651, 661*a* are arranged at regular intervals in the longitudinal direction of the substrate 610. On the other hand, in this embodiment, a distance between the electrical contacts 651*a*, 661*a* contacted to the same voltage source contact is smaller than in Embodiment 3. With such a structure, the area on the substrate 610 required by the provision of the electrical contacts can be reduced, and therefore, the upsizing of the substrate 610 in the longitudinal direction can be further suppressed. The description will be made in detail in conjunction with the accompanying drawings. The structure of the fixing device 40 of Embodiment 4 is fundamentally the same as the those of Embodiment 1 except for the structures relating to the heater 600. In the description of this embodiment, the same reference numerals as in Embodiment 3 are assigned to the elements having the corresponding functions in this embodiment, and the detailed description thereof is omitted for simplicity.

Similarly to Embodiment 3, the electrical contact 641 is contacted to the voltage source contact 110*a*, and the electrical contacts 651, 661*a* are contacted to the voltage source contact 110*b*, in this embodiment. Therefore, a high potential difference can be produced between the electrical contact 641 and the electrical contact 661*a* juxtaposed on the substrate 610. In order to prevent the short circuit due to creepage discharge, it is preferable to provide a sufficient insulation distance between the electrical contact 641 and the electrical contact 661*a*. Japanese Electrical Appliance and Material Safety Law (annex Table of attached Table) stipulates that in a charging portion or other position of different polarities where a voltage between the lines 50V-150V, the required space distance (creeping distance) is approx. 2.5 mm. In this embodiment, taking mounting tolerances of the connector 700 and/or the thermal expansion of the substrate 610 into account, a gap E provided is approx. 4.0 mm. When the gap between the electrical contacts 641 and 661*a* is not constant because of non-parallelism between the electrical contacts 641 and 661*a*, a minimum value of the gap is deemed as the gap E.

The electrical contacts 651 and 661 are adjacent to each other and are connected to the same voltage source contact, and therefore, no high potential difference is produced therebetween. Therefore, the short circuit due to the creepage discharge hardly occurs between the electrical contacts 651 and 661*a* (gap F). Therefore, as long as a function insulation for normal operation of the heater 600 is provided, the gap F can be made minimum. However, in consideration of the mounting tolerances of the connector 700 and the thermal expansion of the substrate 610, the gap F in this embodiment is approx. 1.5 mm. When the gap between the electrical contacts 651 and 661*a* is not constant because of non-parallelism between the electrical contacts 651 and 661*a*, a minimum value of the gap is deemed as the gap F. Gap E>gap F. The gap between the electrical contact 661*a* and the electrical contact 651 is less than gap E in the entirety, by which the length and the width required by the electrical contacts can be reduced.

From the stand point of the electrical contact 661*a*, this means the following. The electrical contact 641 is disposed adjacent to one end portion side of the electrical contact 661*a* with respect to the longitudinal direction of the substrate 610, and the electrical contact 651 is disposed adjacent to the other end portion side of the electrical contact 661*a*. The gap between the electrical contact 661*a* and the electrical contact 651 (approx. 1.5 mm in this embodiment) is less than the gap between the electrical contact 661 and the electrical contact 641*a* (approx. 4 mm in this embodiment). That is, gap E>gap F is satisfied. With such an arrangement, the lengthwise dimension of the substrate can be reduced.

According to this embodiment, the gap between two electrical contacts connected to the same voltage source contact is reduced, by which the total width of the array of the electrical contacts (total of the widths of the electrical contacts and the gap therebetween) can be reduced. By this arrangement, the length increase of the substrate 610 can be suppressed. Or, under the condition that the length of the substrate 610 the same, the number of patterns of the heat generation region can be increased, as compared with the conventional example. In addition, the size of the connector 700 can be reduced.

The order of the electrical contacts is not limited to that described above. For example, the electrical contact 641*a* may be disposed at a position closest to the center of the substrate 610. However, the electrical contact 641*a* is connected to the voltage source contact (110*a*) which is different from the voltage source contact (110*b*) to which the other electrical contacts are connected, and the number of the electrical contacts adjacent to the electrical contact 641*a* is preferably small. Therefore, in the case that a plurality of electrical contacts are juxtaposed, it is preferable that the electrical contact 641*a* is disposed at an end of the array.

As will be understood, in this embodiment, the advantageous effect is provided particularly when the array of the electrical contacts connected to the same voltage source contact extends in the longitudinal direction. Therefore, the advantageous effect is more significant when a larger number of electrical contacts connected to the same voltage source contact are arranged in the longitudinal direction of the substrate 610. Therefore, this embodiment is effective when the number of the electrical contacts increases by increasing the number (3, for example) of the patterns of the heat generating region in Embodiment 1.

In the foregoing description, the arrangement of the electrical contacts is applied to the structure of Embodiment 3, but the arrangement is not limitedly applied to Embodiment 3. For example, the arrangement of the electrical contacts of this embodiment can be used with Embodiment 1. When the arrangement is used with the structure of Embodiment 1, the gap between the electrical contact 661*a* and the electrical contact 661*b* and the gap between the electrical contact 661*b* and the electrical contact 651 can be reduced. The arrangement of the electrical contacts of this embodiment can be applied to the other structure if a plurality of electrical contacts connected to the voltage source contact (110*b*) in one end portion side 610*a* of the substrate are arranged in the longitudinal direction of the substrate 610.

However, it is not easy to apply the arrangement of the electrical contacts of this embodiment to the case of the electric energy supply method of Embodiment 2. This is because the electrical contacts 1641, 1651, 1661, 1671 in Embodiment 2 may be connected to the different voltage source contacts. Therefore, it is difficult to reduce the gap between the electrical contacts.

As described in the foregoing, the increase of the length of the substrate 610 can be suppressed by reducing the gap between the electrical contacts, but the result of the reduction may be utilized for another purpose. For example, when the electrical contacts all arranged in the widthwise direction of the substrate, the increase of the width may be suppressed by reducing the gap between the electrical contacts. Simultaneously, when the width of the electrical contact measured in the longitudinal direction of the substrate is approx. 3 mm, the electrical contacts arranged in the longitudinal direction of the substrate 610 can be reduced, and therefore, the increase of the length of the substrate 610 can be suppressed.

The heaters per se in the foregoing embodiments can be summarized as follows:

A. A heater including an elongated substrate; a first electrode provided on the substrate; a second electrode provided on the substrate and electrically isolated from the first electrode; a third electrode provided on the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate and electrically connected with the electrical contacts of the first group and the second group at a surface of the heater portion closer to the substrate.

B. A heater including an elongated substrate; a first electrode provided on the substrate; a second electrode provided on the substrate and electrically isolated from the first electrode; a third electrode provided on the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate and electrically connected with the electrical contacts of the first group and the second group at a surface of the heater portion remote from to the substrate.

C. A heater including an elongated substrate; a first electrode provided on the substrate; a second electrode provided on the substrate and electrically isolated from the first electrode; a third electrode provided on the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate, the heater portion including parts which are electrically isolated from each other and which are provided between and in contact with adjacent ones of the electrical contacts of the first and second groups at a surface of the heater portion closer to the substrate.

D. A heater including an elongated substrate; a first electrode provided on the substrate; a second electrode provided on the substrate and electrically isolated from the first electrode; a third electrode provided on the substrate and electrically isolated from the first electrode and from the second electrode; a first common electroconductive line provided on the substrate and electrically connected with the first electrode; a second common electroconductive line provided on the substrate and electrically connected with the second electrode; a third common electroconductive line provided on the substrate and electrically connected with the third electrode; a first group of electrical contacts provided on the substrate and electrically connected with the first electrode; a second group of electrical contacts provided on the substrate, the electrical contacts of the first group and the second group being arranged along a longitudinal direction of the substrate in an interlacing relationship, the second group of electrical contacts including a first sub-group of electrical contacts and a second sub-group of electrical contacts, the electrical contacts of the first sub-group being electrically connected with the second common electroconductive line, and the electrical contacts of the second sub-group being electrically connected with the third common electroconductive line; and an elongated electrically energizable heater portion provided on a surface of the substrate, the heater portion including parts which are electrically isolated from each other and which are provided between and in contact with adjacent ones of the electrical contacts of the first and second groups at a surface of the heater portion remote to the substrate.

OTHER EMBODIMENTS

The present invention is not restricted to the specific dimensions in the foregoing embodiments. The dimensions may be changed properly by one skilled in the art depending on the situations. The embodiments may be modified in the concept of the present invention.

The heat generating region of the heater 600 is not limited to the above-described examples which are based on the sheets which are supplied with the center thereof aligned with the center of the fixing device. Alternatively, the heat generating regions of the heater 600 may be modified so as to meet the case in which the sheets are supplied with one end thereof aligned with an end of the fixing device. More particularly, the heat generating elements corresponding to the heat generating region A are not heat generating elements 620*c*-620*j* but are heat generating elements 620*a*-620*e*. With such an arrangement, when the heat generating region is switched from that for a small size sheet to that for a large size sheet, the heat generating region does not expand at both of the opposite end portions, but expands at one of the opposite end portions.

The number of patterns of the heat generating region of the heater 600 is not limited to two. For example, three or more patterns may be provided.

The forming method of the heat generating element 620 is not limited to those disclosed in Embodiments 1, 2. In Embodiment 1, the common electrode 642 and in the opposite electrodes 652, 662 are laminated on the heat generating element 620 extending in the longitudinal direction of the substrate 610. However, the electrodes are formed in the form of an array extending in the longitudinal direction of the substrate 610, and the heat generating elements 620*a*-620*l* may be formed between the adjacent electrodes.

The number of the electrical contacts is not limited to three or four. If all of the electrical contacts are disposed in the one end portion side 610*a* of the substrate, five or more electrical contacts may be provided. For example, in Embodiment 1, in the one end portion side 610*a* of the substrate, an electrical contact different from the electrical contacts 641, 651, 661*a*, 661*b* are provided.

The electrical contact connected to the voltage source contact 110*a* is not limited to the electrical contact 641. For example, in the one end portion side 610*a* of the substrate, an electrical contact which is different from the electrical contact 641 and which is connected to the voltage source contact 110*a* may be provided.

The belt 603 is not limited to that supported by the heater 600 at the inner surface thereof and driven by the roller 70. For example, so-called belt unit type in which the belt is extended around a plurality of rollers and is driven by one of the rollers. However, the structures of Embodiments 1-4 are preferable from the standpoint of low thermal capacity.

The member cooperative with the belt 603 to form of the nip N is not limited to the roller member such as a roller 70. For example, it may be a so-called pressing belt unit including a belt extended around a plurality of rollers.

The image forming apparatus which has been a printer 1 is not limited to that capable of forming a full-color, but it may be a monochromatic image forming apparatus. The image forming apparatus may be a copying machine, a facsimile machine, a multifunction machine having the function of them, or the like, for example.

The image heating apparatus is not limited to the apparatus for fixing a toner image on a sheet P. It may be a device for fixing a semi-fixed toner image into a completely fixed image, or a device for heating an already fixed image. Therefore, the fixing device 40 as the image heating apparatus may be a surface heating apparatus for adjusting a glossiness and/or surface property of the image, for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108594 filed on May 26, 2014, which is hereby incorporated by reference herein in its entirety.

What is claimed is:

1. A heater usable with an image heating apparatus including an electric energy supplying portion provided with a first terminal and a second terminal, a connector portion electrically connected with the electric energy supplying portion, and an endless belt for heating an image on a sheet, wherein said heater is contactable to the belt to heat the belt, said heater comprising:

a substrate;

at least one first electrical contact provided on said substrate and electrically connectable with the first terminal through the connector portion;

a plurality of second electrical contacts provided on said substrate and electrically connectable with the second terminal through the connector portion;

a plurality of electrode portions including first electrode portions electrically connected with said first electrical contact and second electrode portions electrically connected with said second electrical contacts, said first electrode portions and said second electrode portions being arranged alternately with predetermined gaps in a longitudinal direction of said substrate; and a plurality of heat generating portions provided between adjacent ones of said electrode portions so as to electrically connect between adjacent electrode portions, said heat generating portions being capable of generating heat by an electric power supplied between adjacent electrode portions;

wherein said first electrical contact and said second electrical contacts are all disposed in one end portion side of said substrate with respect to the longitudinal direction.

2. A heater according to claim 1, wherein said first electrical contact and said second electrical contacts are concentratedly provided in the one end portion side of the substrate.

3. A heater according to claim 1, further comprising a nipping portion capable of being nipped by said connector portion in the one end portion side.

4. A heater according to claim 1, wherein said second electrical contacts includes a third electrical contact and a fourth electrical contact, and said first electrical contact is disposed at a position closer to one longitudinal end of said substrate than said third and fourth electrical contacts, wherein said first electrical contact has a widthwise dimension as measured in a widthwise direction of said substrate which is larger than that of said third electrical contact.

5. A heater according to claim 4, wherein said third electrical contact is disposed at a position closer to one longitudinal end of said substrate than said fourth electrical contact, and said third electrical contact has a widthwise dimension as measured in a widthwise direction of said substrate which is larger than that of said fourth electrical contact.

6. A heater according to claim 1, wherein a third electrical contact includes an electrical contact disposed adjacent to said first electrical contact with a gap E therebetween in the longitudinal direction, and an electrical contact is disposed adjacent to said third electrical contact with a gap F therebetween in the longitudinal direction, wherein the gap F is narrower than the gap E.

7. A heater according to claim 1, wherein only one of said electrical contacts is electrically connectable with the first terminal of the electric energy supplying portion.

8. An image heating apparatus comprising:

an electric energy supplying portion provided with a first terminal and a second terminal;

a connector portion electrically connected with said electric energy supplying portion;

an endless belt for heating an image on a sheet;

a substrate provided inside said belt and extending in a widthwise direction of said belt;

at least one first electrical contact provided on said substrate and electrically connectable with the first terminal through said connector portion;

a plurality of second electrical contacts provided on said substrate and electrically connectable with the second terminal through said connector portion;

a plurality of electrode portions including first electrode portions electrically connected with said first electrical contact and second electrode portions electrically connected with said second electrical contacts, said first electrode portions and said second electrode portions being arranged alternately with predetermined gaps in a longitudinal direction of said substrate; and a plurality of heat generating portions provided between adjacent ones of said electrode portions so as to electrically connect between adjacent electrode portions, said heat generating portions being capable of generating heat by an electric power supplied between adjacent electrode portions, wherein when a sheet having a maximum width usable with said apparatus is heated, said electric energy supplying portion supplies electric energy to all of said heat generating portions through said first electrical contact and all of said second electrical contacts so that all of said heat generating portions generate heat, and wherein when a sheet having a width smaller than the maximum width is heated, said electric energy supplying portion supplies electric energy to first heat generating portions and to a part of second heat generating portions through said first electrical contact and a part of said second electrical contacts so that a part of said heat generating portions generate heat, and wherein said first electrical contact and said second electrical contacts are all disposed in one end portion side of said substrate with respect to the longitudinal direction.

9. An apparatus according to claim 8, wherein said first electrical contact and said second electrical contacts are concentratedly provided in the one end portion side of the substrate.

10. An apparatus according to claim 8, further comprising a nipping portion capable of being nipped by said connector portion out side a widthwise end of said belt.

11. An apparatus according to claim 8, wherein said second electrical contacts includes a third electrical contact and a fourth electrical contact, and said first electrical contact is disposed at a position closer to one longitudinal end of said substrate than said third and fourth electrical contacts, wherein said first electrical contact has a widthwise dimension as measured in a widthwise direction of said substrate which is larger than that of said third electrical contact.

12. An apparatus according to claim 11, wherein said third electrical contact is disposed at a position closer to one longitudinal end of said substrate than said fourth electrical contact, and said third electrical contact has a widthwise dimension as measured in a widthwise direction of said substrate which is larger than that of said fourth electrical contact.

13. An apparatus according to claim 8, wherein said third electrical contact includes an electrical contact disposed adjacent to said first electrical contact with a gap E therebetween in the longitudinal direction, and an electrical contact is disposed adjacent to said third electrical contact with a gap F therebetween in the longitudinal direction, wherein the gap F is narrower than the gap E.

14. An apparatus according to claim 8, wherein only one of said electrical contacts is electrically connectable with the first terminal of said electric energy supplying portion.

15. An apparatus according to claim 8, wherein when said heat generating portions are supplied with electric energy through all of said first and second electrical contacts, the directions of electric currents through adjacent ones of heat generating portions are opposite to each other.

16. An apparatus according to claim 8, wherein said electric energy supplying portion includes an AC circuit.

* * * * *